US009872100B2

(12) United States Patent
Henry et al.

(10) Patent No.: US 9,872,100 B2
(45) Date of Patent: Jan. 16, 2018

(54) ACOUSTIC APPARATUS AND OPERATION

(71) Applicant: Cerberus Black Ltd, Haywards Health, Sussex (GB)

(72) Inventors: Matthew Henry, Sussex (GB); Edward Kinsella, Surrey (GB)

(73) Assignee: CERBERUS BLACK LTD, West Sussex (GB)

( * ) Notice: Subject to any disclaimer, the term of this patent is extended or adjusted under 35 U.S.C. 154(b) by 39 days.

(21) Appl. No.: 14/892,530

(22) PCT Filed: May 30, 2014

(86) PCT No.: PCT/GB2014/051657
§ 371 (c)(1),
(2) Date: Nov. 19, 2015

(87) PCT Pub. No.: WO2014/191761
PCT Pub. Date: Dec. 4, 2014

(65) Prior Publication Data

US 2016/0105745 A1 Apr. 14, 2016

(30) Foreign Application Priority Data

May 31, 2013 (GB) ..... 1309746.4

(51) Int. Cl.
*H04R 1/30* (2006.01)
*H04R 5/02* (2006.01)
(Continued)

(52) U.S. Cl.
CPC ..... *H04R 1/345* (2013.01); *F41H 13/0081* (2013.01); *G10K 11/26* (2013.01);
(Continued)

(58) Field of Classification Search
CPC ..... H04R 1/30; H04R 1/345; H04R 2201/34; H04R 9/06; G10K 13/00
(Continued)

(56) References Cited

U.S. PATENT DOCUMENTS 4,246,440 A * 1/1981 Van Der Heide ..... H04H 20/34 370/496
5,953,436 A * 9/1999 Zimmermann ..... H04R 1/345 340/388.1
(Continued)

FOREIGN PATENT DOCUMENTS

EP 1071308 1/2001
GB 2226214 6/1990
(Continued)

OTHER PUBLICATIONS

International Search Report and Written Opinion, dated Feb. 6, 2015, by the European Patent Office for corresponding PCT Patent Application No. PCT/GB2014/051657, 10 pages.

*Primary Examiner* — George Monikang
(74) *Attorney, Agent, or Firm* — Klarquist Sparkman, LLP

(57) ABSTRACT

A portable acoustic warning device which projects a specific acoustic waveform towards a target, creating a narrow beam of sound that is highly selective, minimizing exposure to users and bystanders, while enabling a controlled dosage of sound to be applied to the target. The design of the device is tailored to this waveform thus achieving a very high degree of directivity. It is not intended for communicating verbal messages. This waveform achieves maximum intensity at the target while using a relatively low sound pressure level; meaning that the exposure levels can be controlled to ensure they are within existing health and safety legislation. A laser range finder limits the sound level at the target to a pre-determined level. An integrated camera is used to aid
(Continued)

aiming. Video footage is recorded with use; along with the sound level at the target, exposure duration, time, date and GPS coordinates.

14 Claims, 15 Drawing Sheets

(51) Int. Cl.

| | |
|---|---|
| ***H04R 1/34*** | (2006.01) |
| ***F41H 13/00*** | (2006.01) |
| ***G10K 11/26*** | (2006.01) |
| ***H04R 3/00*** | (2006.01) |
| *G10K 13/00* | (2006.01) |

(52) U.S. Cl.
CPC ..... *H04R 1/30* (2013.01); *H04R 3/00* (2013.01); *G10K 13/00* (2013.01); *H04R 2201/34* (2013.01); *H04R 2430/01* (2013.01)

(58) Field of Classification Search
USPC ..... 381/339, 340, 342, 343
See application file for complete search history.

(56) References Cited

U.S. PATENT DOCUMENTS

| | | | | |
|---|---|---|---|---|
| 6,343,133 | B1 * | 1/2002 | Adamson | H04R 1/26 181/152 |
| 6,574,344 | B1 | 6/2003 | Wiener et al. | |
| 7,113,607 | B1 * | 9/2006 | Mullins | H03G 11/002 381/103 |
| 8,050,442 | B1 * | 11/2011 | Graber | H04R 1/20 181/144 |
| 8,194,905 | B1 * | 6/2012 | Vinther, Sr. | H04R 1/26 381/181 |
| 2003/0063754 | A1 * | 4/2003 | Mears | H04R 27/00 381/75 |
| 2008/0037803 | A1 * | 2/2008 | Breed | H04R 5/02 381/86 |
| 2013/0177165 | A1 * | 7/2013 | Oishi | H04R 1/1041 381/74 |

FOREIGN PATENT DOCUMENTS

| | | |
|---|---|---|
| GB | 2511145 | 8/2014 |
| GB | 2520448 | 5/2015 |
| GB | 2520449 | 5/2015 |

* cited by examiner

ACOUSTIC APPARATUS AND OPERATION

CROSS REFERENCE TO RELATED APPLICATIONS

This is the U.S. National Stage of International Application No. PCT/GB2014/051657, filed May 30, 2014, which in turn claims the benefit of and priority to Great Britain Patent Application No. GB1309746.4, filed May 31, 2013.

BACKGROUND

Technical Field of the Invention

Conflict Management is a core function of Police and Law Enforcement agencies across the world. It is also increasingly a function of military forces engaged in peace-keeping and nation-building. The underlying philosophy of Conflict Management is to enable the Police to minimise, as far as possible, the risk of harm to all individuals who find themselves in a conflict situation by managing that situation carefully. Over the years a variety of technologies have been developed to deal with conflict situations and provide new tools to Law Enforcement to help manage them more effectively. These technologies include such things as batons, tear gas, irritant sprays, water cannon, electro-shock devices and baton rounds (rubber bullets). All these technologies have been developed to bridge the gap between passive warnings and the need to use lethal force. Such technologies are categorised as Less Lethal Weapons (LLWs).

The availability of LLWs has led to the development of a framework known as the Force Escalation Spectrum (sometimes called the Force Continuum) which applies to conflict situations which involve the risk of physical confrontation, violence, injury and death. This widely accepted doctrine encourages a progressive escalation of force; by which any Police Officer dealing with a conflict situation attempts to ends that situation with the minimum use of force possible. This benefits the antagonist by giving them as many opportunities as possible to desist before the Officer is obliged to escalate the force used to hazardous levels. It also benefits the Police by showing a tangible commitment to the wider public to use minimum force wherever possible—which has the consequent benefit of being legally defensible in the event of subsequent litigation. Finally, the Force Escalation Spectrum is favourable politically as it demonstrates a government's commitment to the welfare of its citizens by striking a balance between the need to maintain law and order and individual human rights. FIG. 1 shows a representation of the Force Escalation Spectrum—with a warning (in this case verbal) preceding the deployment of Less Lethal options which in turn precede any use of lethal force.

The intrinsic problem with Less Lethal technologies is that they still constitute a hazard to their targets (and sometimes users and bystanders). That hazard may be much lower than the risk of serious injury or death posed by firearms but it is still significant. This is why the term Non-Lethal Weapon has fallen out of favour and the term Less Lethal Weapon has become ubiquitous. If Police forces cannot guarantee that their Conflict Management tools are without risk then they cannot reasonably describe them as Non-Lethal.

The two most commonly used technologies (largely due to scale, cost and practicality) are electro-shock devices and irritant sprays. Electro-shock devices are commonly known as Tasers—the trade name employed by the dominant manufacturer. Irritant sprays come in various forms such as o-chlorobenzylidene malononitrile, CS, which is widely described as Tear Gas and chloroacetophenone, CN, which is commonly known by the trade name Mace. These are both irritants; however they have been largely superseded by Oleoresin *Capsicum* (OC) which is more commonly known as pepper spray. OC is derived from hot spicy peppers of the genus *Capsicum*. It is a lachrymatory agent with an inflammatory effect and can incapacitate a target. It has become the industry standard for irritant sprays because it is believed to be less toxic and also shows more consistency of effect upon targets including those under the influence of alcohol or drugs.

Whilst undoubtedly softer options than firearms; the safety of both these technologies has regularly been questioned, and both have been connected to incidents resulting in injury and death. Amnesty International implicates Tasers in the death in custody of over 300 people in the US over a seven year period in their 2008 report "Less Than Lethal—The Use of Stun Weapons in US Law Enforcement". Whilst a well cited paper in the North Carolina Medical Journal, volume 60, no. 5, of 1999 "Health Hazards of Pepper Spray" raises serious questions about the safety of pepper spray—as well as citing incidents where its use may have been contributory to fatalities.

Furthermore the misuse of such tools has attracted widespread publicity and condemnation: particularly contentious recent examples include a blind man mistakenly electro-shocked by UK Police in 2013 and the indiscriminate use of pepper spray upon a peaceful student demonstration on the campus of the University of California in 2011.

This concern and criticism illustrates a truth for all Less Lethal technologies in use today—that they all constitute a use of force upon the target—and in any use of force, no matter how controlled, there is intrinsic risk.

Knowing that risks exist highlights the fact that Police Officers suffer a paucity of pre-force options on the Force Escalation Spectrum. Being electro-shocked would seem a much better option than being shot, but being shocked or pepper sprayed after only a verbal warning might seem excessive.

Hence there is a capability gap on this spectrum between a warning (verbal or visual) and the use of Force—a capability gap at the softer end of the spectrum—a gap that could be bridged by a technology that projects a forceful warning but with negligible risk to the target.

Description of Related Art

In recent years the ability to project a verbal audio warning has expanded due to the development of Audio Hailing Devices (AHDs). Several companies have developed AHDs which can create very high sound levels from relatively compact vehicle mounted devices. These devices offer the opportunity to project verbal communications over great distances—hundreds of meters or more—depending on prevailing weather conditions. They also offer the facility of projecting attention grabbing audio warning tones similar to Police sirens. Such AHDs could be said to address this capability gap—by enabling a projected warning—however in practice these technologies present a significant safety hazard and so cannot be considered a risk free option.

A primary commercial entity in this sector is the LRAD Corporation of San Diego, Calif.; formally known as the American Technology Corporation (ATC). They have a portfolio of patents which describe how they generate very high levels of sound from compact phase-matched arrays of transducers often made from piezo-electric thin films and coupled by acoustic impedance matching mini-horns. A core patent in their portfolio is US2004/0052387, Norris and Croft III. Using this technology they have developed products such as the LRAD 1000X which is specified to produce a maximum sound pressure level of 153 dB(A) at 1 m and be audible over 1000 m dependent on weather and ambient conditions.

Other companies that offer products that claim to perform to similar levels using different technology include Ultra Electronics of Columbia City, Ind., who produce the Hyperspike range of AHDs; some of which incorporate technology protected with patents like U.S. Pat. No. 7,912,234, Curtis E. Graber, which describes an array of transducers positioned at the focal point of a parabolic dish which then reflects their combined output in a desired direction. Their HS24 unit, which claims a maximum output of 153 dB at 1 m with an effective range of 1500 m, appears to utilise this configuration.

These technologies are effective at communicating or signalling over a long range, and are very much more compact, mobile and practical than conventional public address systems but they do have some significant drawbacks. For instance, such systems are typically quite large and must be vehicle mounted and powered.

However the primary drawback for use in Conflict Management is that they are not very directional at the audio frequencies used for verbal communication—which combined with their very high output levels—makes them extremely hazardous at close range to target, bystanders and users.

The sound level produced at maximum output for the cited units, 153 dB A-weighted(A), is more than four times greater (by pressure) than the maximum instantaneous limit specified by Health & Safety legislation across the US and Europe of 140 dB C-weighted (C). This means that anyone experiencing the sound source at close range has the potential to suffer instantaneous permanent hearing damage. Even at range the sound levels can be so high that the safe daily exposure time is fractions of a second. For example at 153 dB (A) output at 1 m would equate to a sound level of around 133 dB (A) at 10 m which has a safe daily exposure time of 0.7 seconds under EU legislation. This necessitates the user wearing ear protection, preventing normal communication, and puts bystanders—even those behind the device—at serious risk of harm in a very short timeframe.

A further problem is that there is no means to control or record the dosage experienced by the target. This means that there is no way of proving that the sound levels experienced by the target or anybody else are within safe limits. This potentially opens up the users of such devices to litigation for exposing targets, operators and bystanders alike to dangerous levels of sound.

This means that AHDs, whilst effective means of conveying a verbal message, are both indiscriminate and hazardous at short range with potential for causing permanent auditory injury. Thus they are as hazardous in practice as other LLWs and so cannot be said to offer a softer bridging option on the Force Escalation Spectrum.

Both LRAD and Ultra Electronics offer smaller battery-powered portable systems—the LRAD100X and the HS Micro respectively. These are designed to be portable in the sense that they can be carried from place to place; but not in the sense that they can be worn and used as mobile tools. These units are significantly less powerful than their larger equivalents with maximum outputs of 137 dB (A) and 140 dB (A) respectively and effective ranges of 100s of meters.

However they still suffer from the same lack of discrimination and exposure control as their larger counterparts and are still potentially dangerous in use. For example at 4 m range at target would experience around 126 dB (A) from the HS Micro at full power. The safe daily exposure time at this level under EU law is only 3.6 s. Therefore it is easy to imagine how targets, users and bystanders could rapidly be exposed to sound levels which exceed the safe daily limit—and without control or monitoring it would be difficult to prove otherwise.

The LRAD Corporation also has related intellectual property relating to a scheme for generating highly directional high amplitude ultrasound which can then be perceived as audio-level sound at a target due to local non-linear effects in the air, an example patent of which is US2003/0215103 Norris and Croft III. This is utilised in a range of products with the trade name of Soundsabre and offers the potential for being highly selective and discriminatory communication tools. However range is limited due to the high absorption of ultrasound in air and external criticism suggests that the quality of audio reproduction at the target is insufficient for intelligible verbal communication. At the time of writing it appears that these devices are not commercially available.

Other schemes have been put forward for portable sound technologies to be used in Conflict Management situations; for example U.S. Pat. No. 3,557,899, Lucas and Porter, describes an acoustic system that uses hand-held parabolic dishes to project audio frequencies between 8 and 13 kHz that it claims can disturb human and animal brain stimulus frequencies inducing repulsion—although no explanation is offered as to why these frequencies will have that effect. Alternatively U.S. Pat. No. 5,973,999, Naff and Shea, describes a hand-held device which employs an array of phase matched explosive compression sources which creates a non-linear shock wave which propagates a useful distance and could be used as a LLW. This device has the potential for causing instantaneous hearing damage to any target due to the very high pressure levels claimed. Neither of these proposed technologies appears to have been commercialised.

SUMMARY OF THE INVENTION

The invention is set out in the claims.

In overview a design for a portable acoustic device is presented that projects a specific acoustic waveform towards a target creating a narrow beam of sound that is highly selective, minimising exposure to users and bystanders, whilst enabling a controlled dosage of sound to be applied to the target. This narrow cone of sound acts as a clear warning of Police attention at range and as the target nears the intensity rises creating a naturally escalating deterrent.

A unique acoustic waveform is created using principals from the field of psycho-acoustics and empirical studies to produce an auditory tone which has maximum impact upon the target. Using physiological and neurological principals from the analysis of human hearing it is possible to create a noise which seems much louder and more piercing than it really is. This means that it is possible to operate the device at relatively low sound pressure levels and yet still achieve the impression of great intensity at the target. By operating at relatively low sound levels it becomes possible to ensure that device operates within existing health and safety legislation on noise exposure—for example Directive 2003/10/EC of the European Parliament.

The device is designed around this specific acoustic waveform. It is not designed to project verbal communication. It is thus possible to design a system which produces a very narrow beam of sound when projecting this specific auditory tone.

The technology employs a commercial transducer which is coupled into an impedance matching horn whose innovative design engenders this narrow beam of sound. This horn is designed to strike an optimal balance between providing a highly selective acoustic output and being of small enough dimensions to ensure that it is fully manportable and can be worn comfortably by the user for a significant period of time. This is achieved by carefully selecting the dimensions and profile both of the horn and its central phase plug as well as the utilisation of acoustically absorbing foam both internally and externally.

It is found that simply creating a narrow core beam is insufficient to achieve target selectivity in practice. It is determined that eliminating perceptible side-lobing, achieving a very high rate of sound pressure level drop-off at the edges of the core beam and ensuring minimal off-axis sound levels is also necessary to achieve the desired selectivity.

This results in an acoustic output where the user and bystanders experience less than one percent of the sound pressure level (SPL) experienced by the target at an equivalent range. A sound level which allows normal conversation between the user and colleagues, eliminates the need for user hearing protection, and is within safe daily exposure levels for more than an hour of continuous use.

The device also incorporates a commercially available laser range finder. Before the acoustic output is triggered the laser range finder measures the distance to the target. This information is compared to a look-up table of SPL vs. distance and the output of the device is limited to ensure that the SPL at the target never exceeds a pre-set value. This takes place before the acoustic output is generated, but is very rapid and thus imperceptible to the user triggering the device. This safety limiting function ensures that a target is never exposed to hazardous sound levels, even at point blank range, guaranteeing compliance with health and safety law.

Aiming a directional acoustic device accurately is difficult because the user cannot readily pin-point its direction from behind. This device incorporates a video camera which is aligned to the centre of the acoustic output. The video feed from this camera is sent to a high brightness flat panel display mounted upon the device at a convenient position for the user to view. Furthermore cross-hairs are overlaid upon the video, allowing the user to easily and accurately aim the device at the desired target. Other information is provided on the screen to aid the user in utilising the device effectively.

The video feed is also recorded whenever the device is triggered; incorporating a video buffer both before and after the audio output is activated to provide contextual information. A Global Positioning System (GPS) unit is also incorporated within the device. Combined with the data from the laser range finder this provides a very strong evidential trail to justify the use of the device as well as demonstrating that it complies with existing health and safety legislation. Video footage, range, sound level at the target, exposure time, GPS location, time and date are all recorded on a removable memory store within the device whenever it is activated; providing a comprehensive record of use that can act as both an internal audit trail and evidence in any subsequent inquiry.

The device is given the trade name Acoustic—Warning Signal Projector™ or A-WaSP™' Due to its extremely high levels of selectivity; and ability to operate effectively as a projected warning whilst remaining within safe daily exposure limits for the target, user and bystanders; it fits neatly within the cited capability gap between a passive warning and more hazardous LLWs on the Force Escalation Spectrum—as shown in FIG. 2.

BRIEF DESCRIPTION OF THE DRAWINGS

The forgoing objects described herein may be better understood with reference to the following drawings, which are intended for example purposes only.

DETAILED DESCRIPTION OF THE PREFERRED EMBODIMENT

In overview a design for a portable acoustic device is presented that projects a specific acoustic waveform towards a target, creating a narrow beam of sound that is highly selective, minimising exposure to users and bystanders, whilst enabling a controlled dosage of sound to be applied to the target. This narrow cone of sound acts as a clear warning of Police attention at range and as the target nears the intensity rises creating a naturally escalating deterrent. The acoustic waveform is specified using principals from the field of psycho-acoustics combined with empirical human studies. The design of the device is tailored to this waveform which allows a very high degree of directivity to be achieved. It is not intended as a tool for the communication of verbal messages. This waveform achieves maximum impact and intensity at the target whilst using a relatively low sound pressure level. This means that the exposure levels can be controlled to ensure they are within existing health and safety legislation. A laser range finder is included which measures the distance to the target and automatically limits the sound level they experience to a pre-determined level. An integrated camera is used to show live feed to the user via an integral flat panel display to aid aiming. This video footage is recorded whenever the device is activated; along with the sound level as determined by the laser range finder, duration of exposure, time, date and GPS coordinates. This provides a record which can demonstrate context of use and compliance with health and safety law. The intention is to create a complete tool to give Police and Law Enforcement agencies a new option on the Force Escalation Spectrum that bridges the gap between a passive warning and a less lethal weapon.

The derivation of an optimised acoustic waveform is from analysis of psycho-acoustic principals coupled and validated with volunteer testing. The objective for this acoustic signal is to achieve the maximum possible impact and intensity at the target but at the lowest SPL required to engender this effect.

Figure 1:
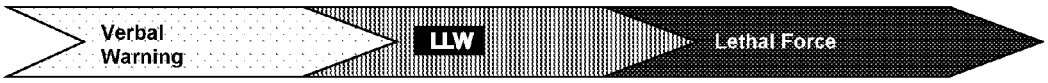
FIG. 1 shows a graphical representation of the Force Escalation Spectrum
Figure 2:
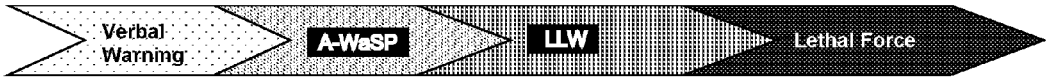
FIG. 2 shows the envisaged position of the A-WaSP™ on the Force Escalation Spectrum
Figure 3:
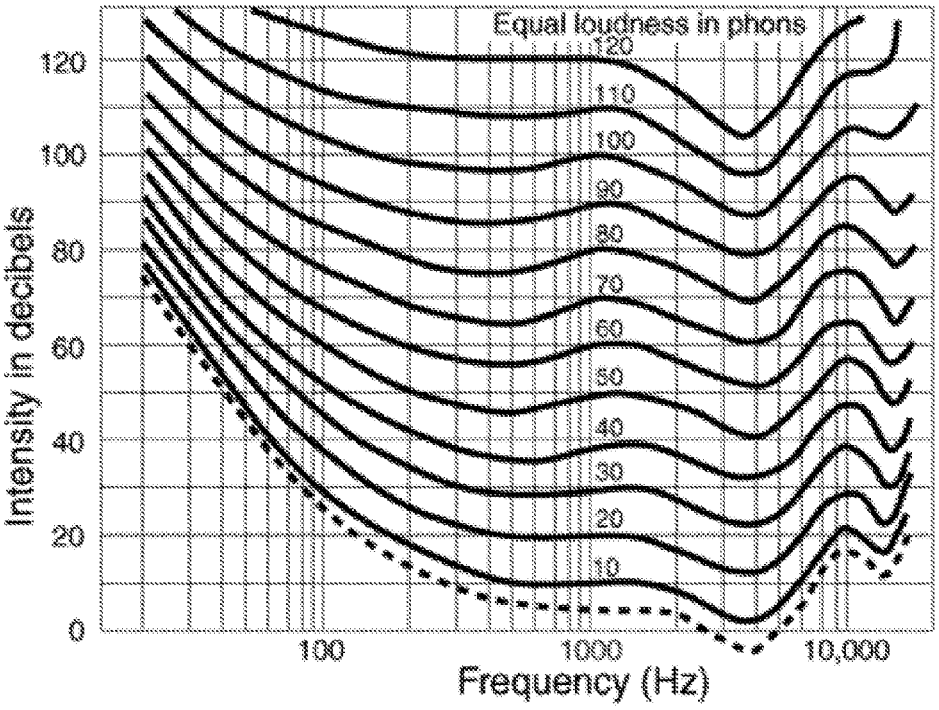
FIG. 3 shows a plot of loudness curves relative to a 1 kHz sine wave reference tone at different sound pressure levels

FIG. 3 shows a representation of the famous Fletcher-Munson set of loudness curves first derived in 1933 and refined by Robinson and Dadson in the 1950s. It shows the sensitivity of human hearing over a broad range of frequencies relative to a 1 kHz sine wave reference tone (in the non SI unit of Phons). The curves show how loud a tone of a given frequency must be in terms of measured sound pressure level to be perceived as having the same loudness as the 1 kHz tone for a given SPL. Different curves are derived at different SPLs relative to the 1 kHz tone rising in 10 dB increments from the onset of hearing at 0 dB up to very loud sounds at 120 dB. The loudness curves show how average human hearing varies non-linearly both with frequency and SPL.

These curves demonstrate that average human hearing has peak acuity between 3 to 5 kHz and more specifically between 3.5 to 4 kHz. This corresponds to the first resonance of the auditory canal when a standing wave can develop within the ear canal itself. The curves show that the human ear can perceive sound as up to 15 dB louder in this region than at 1 kHz. Therefore to create the maximum impression of intensity at the lowest possible SPL the waveform must be based within this region of peak auditory acuity.

Human physiology varies and so the precise frequency that achieves resonance varies by subject, therefore in order to ensure that resonance is achieved the acoustic signal must include a frequency modulation from 3.5 to 4 kHz. Therefore the preferred embodiment is a sine wave, with constant amplitude, that frequency modulates from 3.5 to 4 kHz over a period of time. Volunteer testing supports this as the optimum range to achieve maximum intensity for a given SPL.

This is similar to the effect of a Police siren although over a much shorter frequency range. Sirens for emergency services can modulate from frequencies as low as 0.5 kHz up to 4 kHz because lower frequency sounds can be heard at greater range due to greater diffraction and lower absorption of longer wavelength audible tones. This means approaching vehicles can be heard from further away but that the intensity increases as they near. This works well for omnidirectional auditory warning, but the proposed embodiment is for the opposite, a selective directional warning—so the proposed range is most appropriate.

Figure 4:
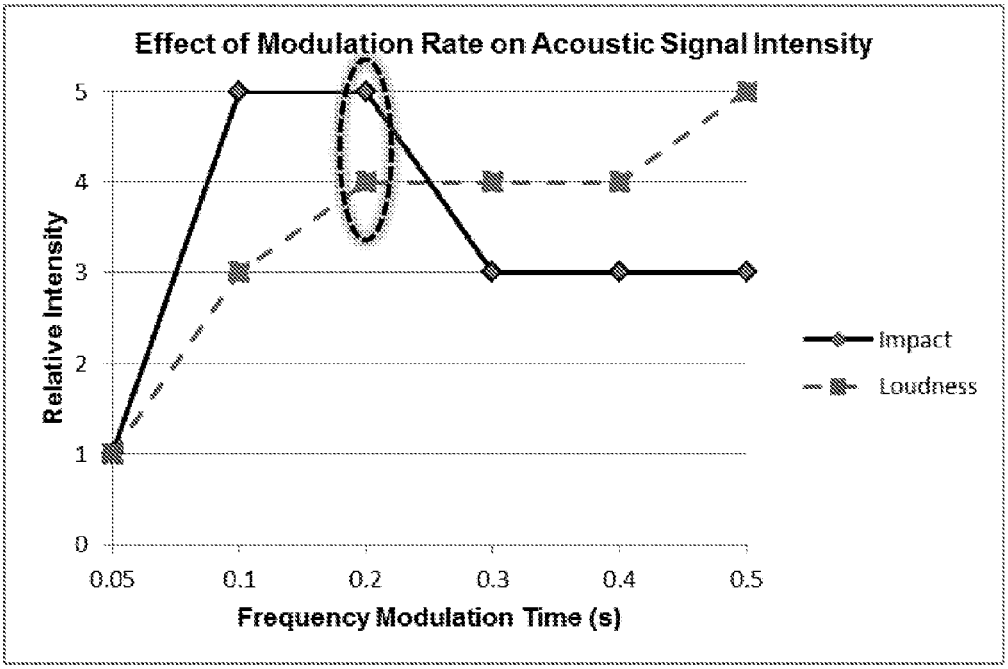
FIG. 4 shows a graph comparing the relative intensity of a frequency modulated acoustic signal at various modulation rates

The rate of modulation from 3.5 to 4 kHz has a significant effect upon the perceived sound intensity. FIG. 4 shows the results of empirical tests for a range of modulation times from 0.05 to 0.5 seconds at constant SPL over a number of seconds. It is found that the perception of loudness and the perception of intensity in terms of impact vary separately with modulation rate. The grey dashed line indicates relative loudness by modulation time. The black line indicates relative impact by modulation time.

Loudness in this instance is simply a judgement by the test subject of which modulation rate has the greatest perceived volume relative to the others for any proportion of the sound exposure. By comparison impact is a subjective judgement of how forceful the signal tone is for the full duration of the sound exposure.

It is found that relative loudness increases to a maximum with a longer modulation time. This is thought to be because the slower rate of modulation means that the point of peak resonance in the ear canal lasts longer. However the impact is less than at a more rapid rate of modulation. This is because only a minority of the modulation time is at or near the point of resonance. Thus as the frequency modulates the loudness reaches a peak but that peak is brief relative to the rest of the modulation cycle.

By comparison a shorter frequency modulation time increases impact. This is thought to be because for a given exposure time the frequency passes through the point of resonance more often e.g. a frequency modulation time of 0.2 s (a rate of 5 Hz) is at resonance twice as much as a frequency modulation time of 0.4 s (a rate of 2.5 Hz) over the same time period. A greater resonance corresponds to a greater impact. Subjects report a sensation as if their head is "buzzing" when the modulation rate is optimised; indicating maximum resonance of the auditory canal.

However if the modulation time is too short, as for 0.05 s (a rate of 20 Hz) the perceived impact and loudness both diminish. This is thought to be because there is insufficient time for a standing wave to develop and be perceived by the inner ear.

Therefore a modulation rate which maximises both relative impact and loudness to achieve a corresponding maximum intensity must be selected. This is shown on FIG. 4 as a dashed ring. Therefore the preferred embodiment of the waveform is a sine wave that repeatedly modulates from a frequency of 3.5 to 4 kHz over a time period of 0.2 s (modulation rate of 5 Hz). The optimum frequency modulation is found to be linear with time but other non-linear modulations may also be appropriate.

Figure 5:
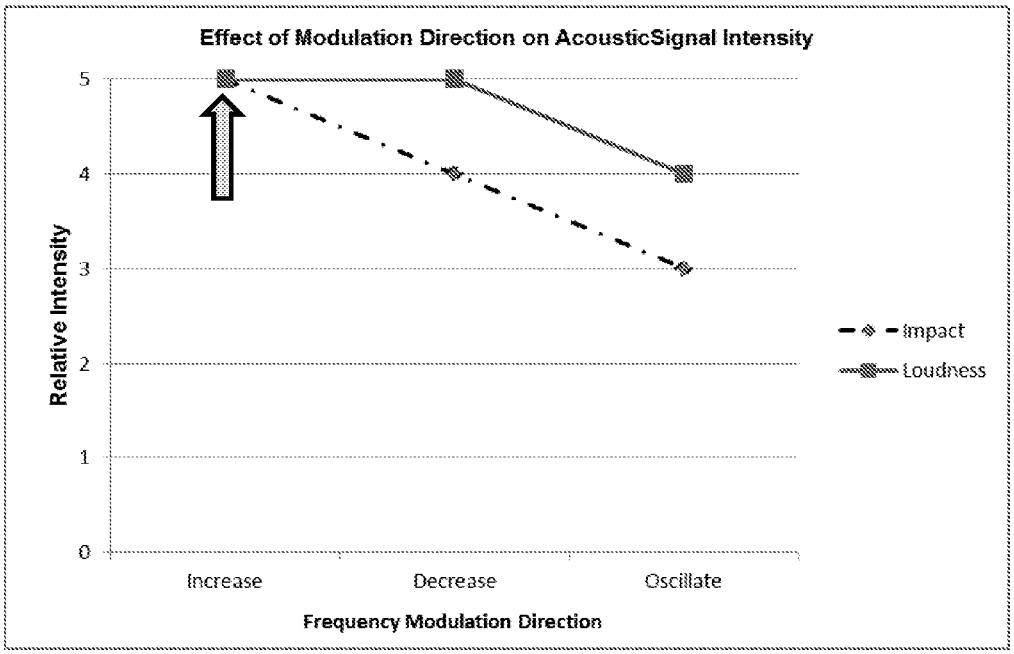
FIG. 5 shows a graph comparing the relative intensity of a frequency modulated acoustic signal by the modulation direction

FIG. 5 shows tests conducted upon the effect of the modulation direction upon the acoustic signal intensity for human subjects using the above preferred embodiment at a constant SPL. As before, it is found that the impact and loudness can be separated by effect. The dot and dashed line is for relative impact, the solid grey line is for relative loudness. Three tests were undertaken; the first where the frequency modulation is from low to high 3500 to 4000 Hz described as "increase"; the second in which the frequency modulation is high to low 4000 to 3500 Hz described as "decrease"; and the third in which the frequency modulation is from low to high then back to low, 3500 to 4000 to 3500 Hz described as "oscillate". In all cases the modulation rate is 5 Hz (modulation time of 0.2 s) except for "oscillate" where it is 2.5 Hz to ensure the rate of modulation by frequency change is constant. The three tones repeat their modulation for several seconds in testing—whilst the modulation direction remains constant.

It is found that a single modulation direction has the greatest impression of loudness, regardless of direction, whilst the oscillating tone has the least. It is also found that the oscillating tone has the least impression of impact, whilst the increasing modulation direction has a greater impact than that of the decreasing one.

It is speculated that the impact of the oscillating tone is less than the other two because there is no sudden change in frequency—whereas, for example, the increase tone has an instantaneous jump of 4000 Hz to 3500 Hz as the frequency modulation cycle repeats. This sudden frequency shift may feel more "harsh" on the ear than the progressive change of the oscillating modulation. It is unclear why the increasing modulation has a greater impact than the decreasing one.

Nonetheless an increasing modulation is identified as possessing the greatest intensity (as shown by the arrow on FIG. 5) therefore the preferred embodiment of the waveform is a sine wave that repeatedly modulates from a frequency of 3.5 to 4 kHz over a time period of 0.2 s (modulation rate of 5 Hz) in a single direction of increasing frequency from 3500 Hz to 4000 Hz. This is shown graphically in FIG. 6 which displays a plot of frequency versus time and shows the repeating modulation by frequency over a 1 second time period. The dotted line shows this preferred embodiment.

A sine wave frequency modulated over the region of peak human auditory sensitivity with optimised modulation characteristics is very piercing and intense relative to any other ambient sound. However it is possible to further increase its piercing, harsh intensity by inverting the psycho-acoustic concept of consonance.

It is widely agreed that the human auditory system carries out its frequency analysis of sound by separating different frequency components into vibrations in different locations upon the Basilar membrane within the inner ear. Thus it can instantly perceive complex sounds by breaking them down into different frequency elements—which allows humans to differentiate extremely complex repeating and non-repeating sounds in terms of timbre and pitch.

Figure 7:
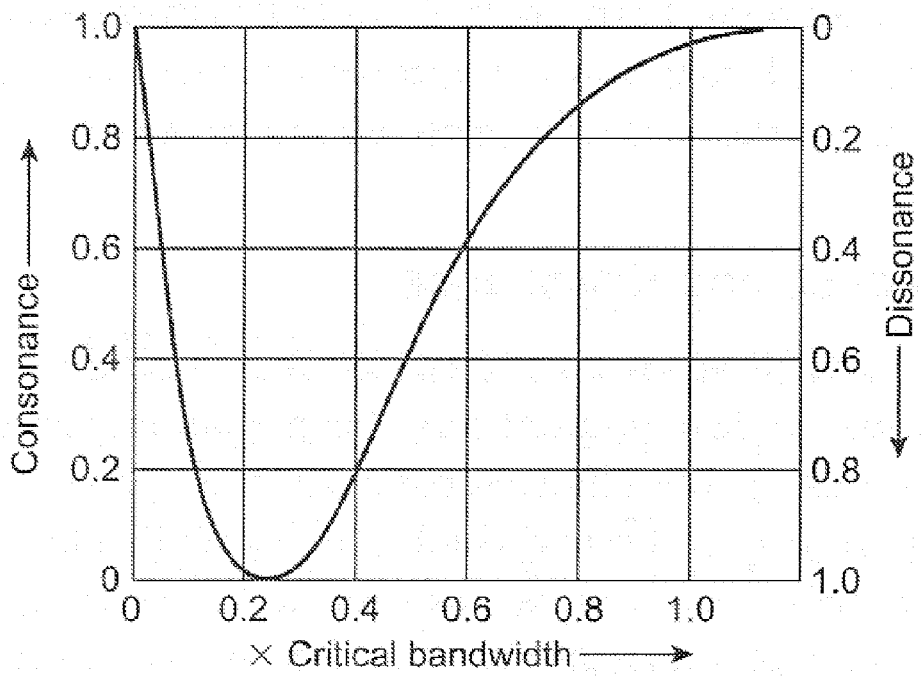
FIG. 7 shows the relative auditory impressions of consonance and dissonance of two overlaid sine waves with varying frequency separations defined by critical bandwidth

A key concept in quantifying this effect is Critical Bandwidth (CB) which is defined as the point at which two sine waves have sufficient frequency separation to be perceived as two distinct tones as opposed to a complex single tone. In 1990 Glasberg and Moore proposed an equation to predict this threshold for any two tones within the main human auditory range (100 Hz to 10,000 Hz). This defines the frequency analysis achieved by the Basilar membrane in terms of a sequence of band pass filters with an ideal rectangular frequency response. It is called the Equivalent Rectangular Bandwidth or ERB and the equation is shown below.

$$ERB=24.7\times[(4.37\times f_c)+1]$$

Where ERB=equivalent rectangular bandwidth in Hz; and $f_c$=the filter centre frequency in kHz.

Where two sine waves are heard together within the CB (or ERB as the two are synonymous in this instance) the difference between their frequencies affects how pleasant—consonant; or unpleasant—dissonant the total sound is to the listener. FIG. 7 is a representation of the results of an experiment carried out by Plomp and Levelt in 1965 where two pure tone sine waves of constant amplitude are played together and their frequency separation varied as a function of critical bandwidth. Where the frequencies are the same they are judged perfectly consonant. Where the frequency separation is greater or equal to one critical bandwidth they are also judged consonant. For frequency differences between 5 and 50% of the critical bandwidth the interval is considered predominantly dissonant. Maximum dissonance is considered to occur at a frequency difference of one quarter of the critical bandwidth.

Figure 8:
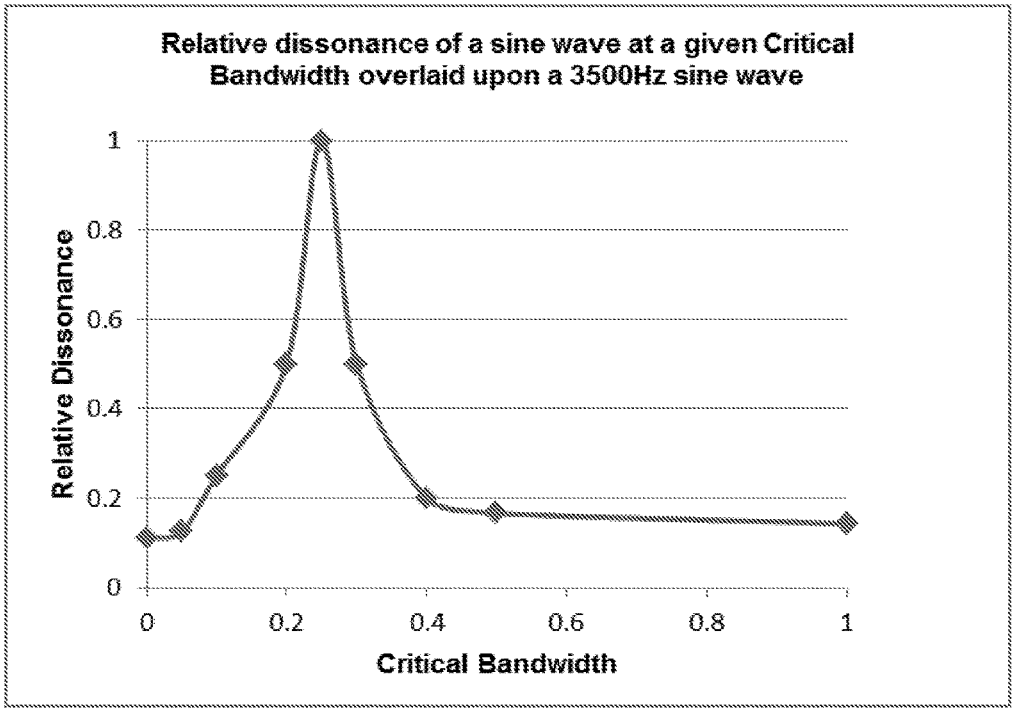
FIG. 8 shows the relative dissonance of two overlaid sine waves as a function of critical bandwidth where the first sine wave is fixed at 3500 Hz

By utilising this principal of dissonance it becomes possible to increase the perceived harshness of the acoustic waveform, increasing its intensity without needing to increase the SPL. FIG. 8 shows empirical testing of this approach where a sine wave of equivalent amplitude is overlaid upon a sine wave of 3500 Hz with various frequency separations as a function of critical bandwidth as calculated using the Glasberg-Moore equation. The frequency separation for maximum dissonance exactly corresponds to the findings of Plomp-Levelt—being located at ¼ of the critical bandwidth of the primary sine wave.

This translates effectively when a frequency modulation is added to both sine waves and the resulting acoustic signal is found to be significantly more unpleasant, and therefore intense, than the primary sine wave alone. The directivity of the device increases with frequency so the optimum embodiment is for the additional overlaid sine wave to be one quarter of the critical bandwidth above the primary sine-wave and for that separation to remain constant throughout the modulation.

Therefore the preferred embodiment of the waveform is a sine wave that repeatedly modulates from a frequency of 3500 to 4000 Hz over a time period of 0.2 s (modulation rate of 5 Hz) in a single direction of increasing frequency from 3500 Hz to 4000 Hz with a corresponding overlaid sine wave of the same amplitude that modulates from a frequency of 3600.6 Hz to 4114.1 Hz with otherwise identical modulation characteristics.

Figure 6:
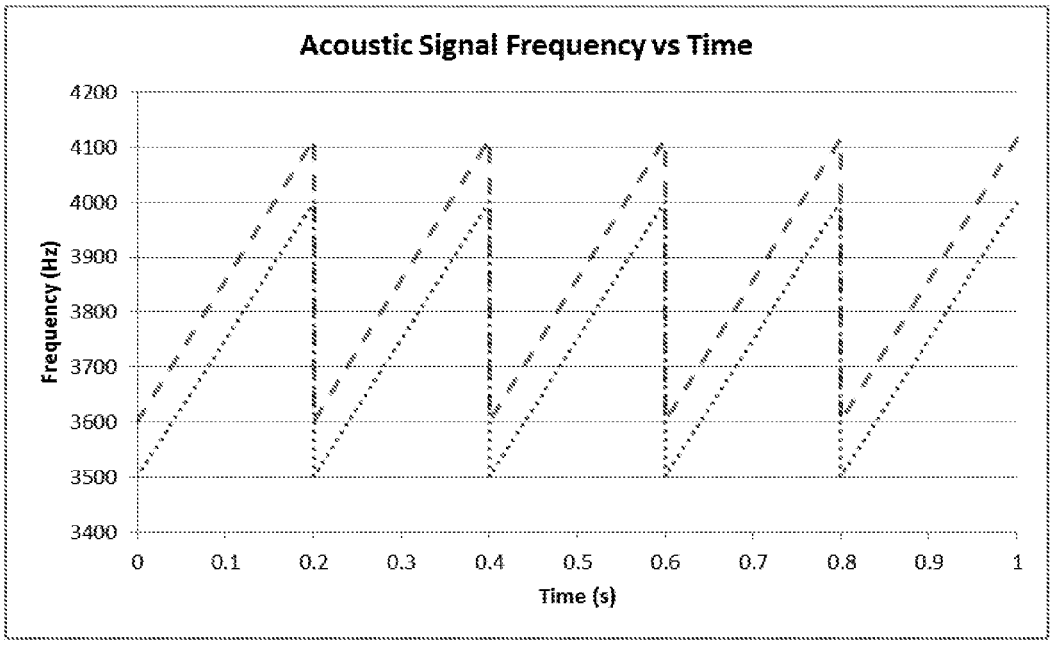
FIG. 6 shows a graph of overlaid acoustic signal frequencies varying with time

This is shown graphically in FIG. 6, by which the dotted line is the core sine wave that modulates from 3500 to 4000 Hz every 0.2 s and the dashed line is the corresponding overlaid sine wave that modulates from 3600.6 Hz to 4114.1 Hz.

Empirical testing shows that a further and final embodiment for the acoustic waveform is preferred. This is two sine waves of equal amplitude modulating in opposite directions i.e. the first sine wave modulating from 3500 to 4000 Hz in 0.2 s whilst the second sine wave modulates from 4000 to 3500 Hz in 0.2 s with this cycle repeating for the desired duration. It is thought that this has a greater intensity because the first resonance of the ear canal is stimulated twice in each cycle. In addition the cross-modulating sine waves spend a significant proportion of the cycle with their frequencies a dissonant fraction of their CB apart; so this waveform is still highly dissonant.

Figure 9:
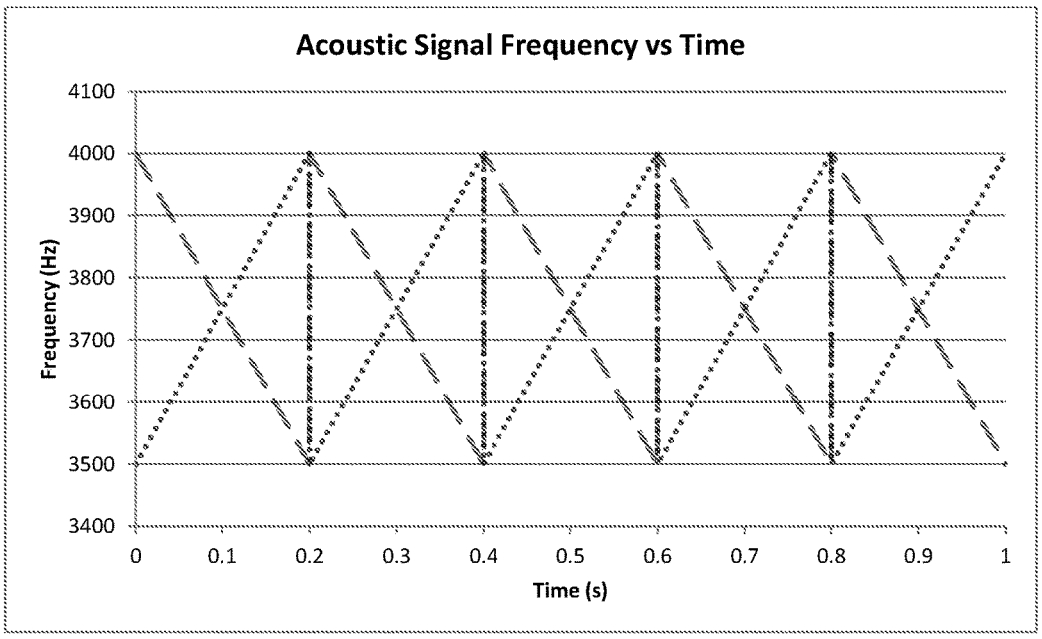
FIG. 9 shows a graph of overlaid acoustic signal frequencies varying with time

This is shown graphically in FIG. 9 in a plot of frequency versus time, by which the dotted line is the first sine wave that modulates from 3500 to 4000 Hz every 0.2 s and the dashed grey line is the second sine wave that modulates in the opposite direction from 4000 Hz to 3500 Hz.

Experiments with three or more sine waves at maximum dissonance are found to be ineffective as the intensity is reduced. The approach of adding one or more modulating or constant sine waves at frequencies well above the critical bandwidth to increase the stimulation of the Basilar membrane across its full length thus increasing the perception of loudness is also found to be ineffective. In practice the clarity of the primary signal is diminished by the addition of these overtones and the total intensity reduced.

An alternative approach is to add pink noise to ERBs above the primary CB to increase stimulation of the Basilar membrane to increase the impression of loudness without affecting the SPL but results are as yet ambiguous in perception of intensity.

In an embodiment, the optimised waveforms shown in FIGS. 6 and 9 could also be employed in applications beyond the use of the A-WaSP™. An alternative application for them, if broadcast through conventional or existing sound production equipment with a low directivity or omnidirectional output, would be to repel assailants or intruders from a given zone by creating a region of maximum sound intensity. This could be employed to protect motor vehicles, ships, buildings and temporary structures.

With the optimal waveform established the mechanical design of the device is then optimised to that waveform to maximise directionality of the acoustic output to enable a controlled sound exposure at the target and minimise exposure to bystanders and the user. Proprietary Finite Element Analysis software is employed in conjunction with empirical testing in an anechoic chamber using a CLIO acoustic software test suite, a rotary stage and microphones calibrated to National Physical Laboratory standards. This leads to an empirically qualified optimisation of the mechanical design of the device.

A commercially available transducer is employed, in this instance a Radian 745 NEO PB compression driver with a 1.4" exit throat diameter. This unit represents an optimal balance between mass and performance at the relevant frequency range. The transducer is attached to a divergent horn which is the most efficient method known for energy coupling from an acoustic source to the ambient environment. It works by means of progressive acoustic impedance matching. Horn-loaded compression drivers are widely acknowledged to be the most efficient systems for converting electrical energy into acoustic energy in the human auditory range. This phenomenon is described in such seminal works as Acoustical Engineering by Harry F. Olsen (1957). Thus this represents the best approach to create a high efficiency, high output acoustic device which is both man-portable and battery-powered.

Figure 10:
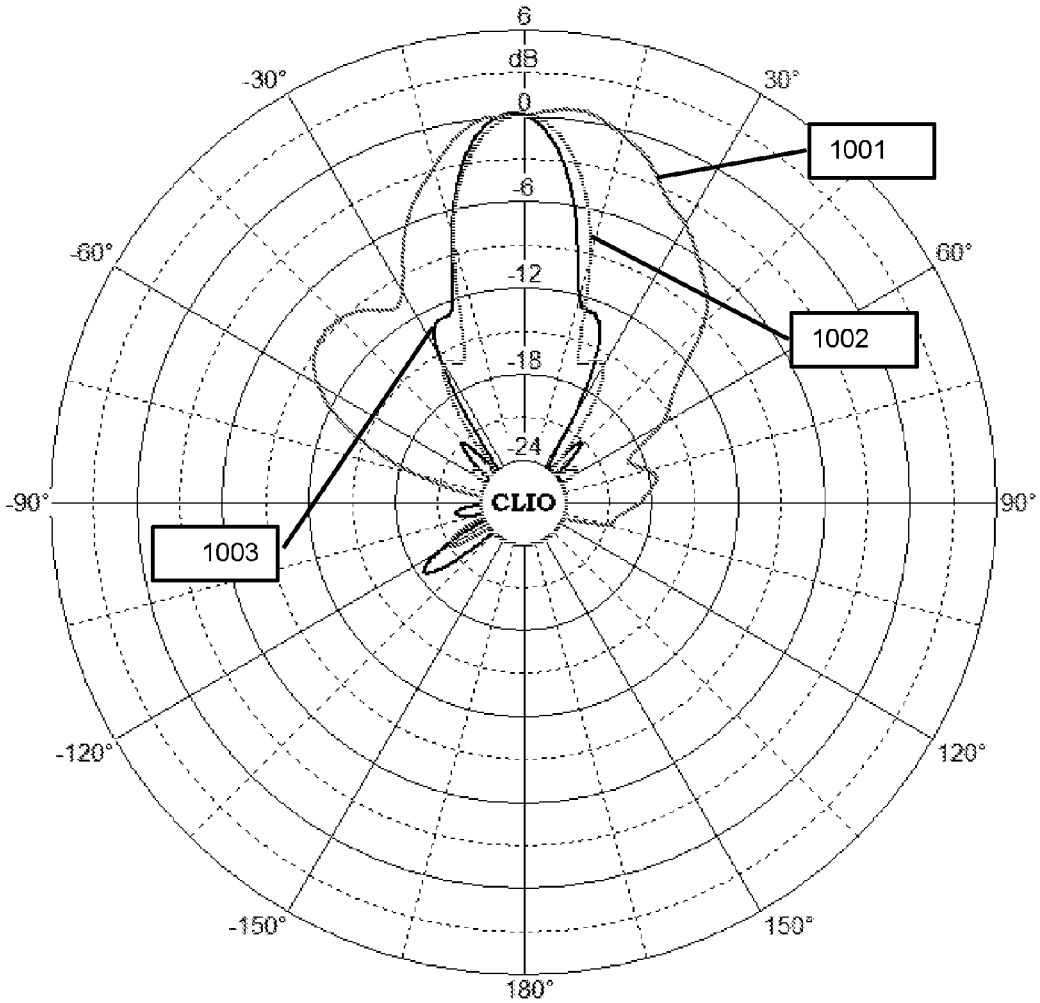
FIG. 10 shows a 360 degree polar profile from 0 to −24 dB comparing the directivity of exponential, parabolic and conical horns

The structure of the horn controls the directionality of the acoustic output and therefore its design is critical to the performance of the proposed device. FIG. 10 shows a 360 degree polar profile of the output for three different horn profiles, all at an output frequency of 4 kHz, and normalised to 0 dB over a range of 0 to −24 dB to allow direct comparison. The solid grey line 1001 is the output of an exponential horn, the dashed line 1002 is the output of a parabolic horn and the solid black line 1003 is the output of a conical horn. All are of similar dimensions and identified as possible candidates for the core horn shape of the device. It can be seen that the exponential horn 1001 produces an asymmetric output with a broad directivity and therefore is unsuitable. The parabolic horn profile 1002 produces a symmetric output with a much narrower core beam, however the optimum is found to be the conical horn profile 1003 which produces the narrowest core beam and therefore the most directional output.

Figure 11:
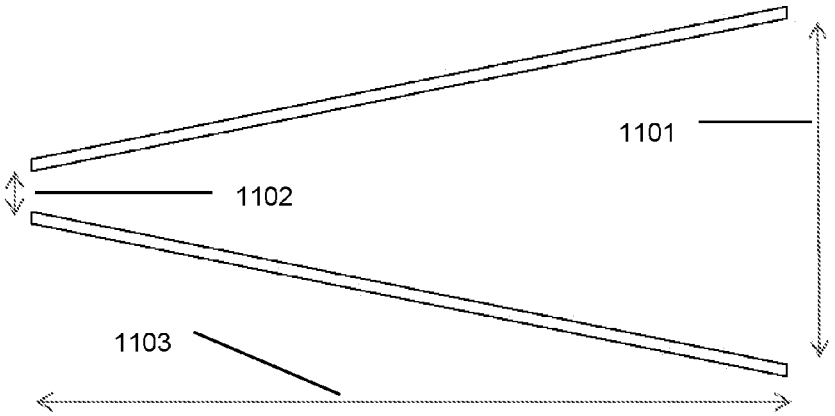
FIG. 11 shows a dimensioned cross section of the optimised conical horn

FIG. 11 shows a cross-sectional profile of the conical horn found to be optimal for the proposed device. It could be manufactured from any suitable material; metal, ceramic, stone plastic, carbon fibre or hardened foam; however the preferred embodiment is found to be either an injection moulded plastic such as Acrylonitrile Butadiene Styrene (ABS) or Polypropylene (PP) or a reaction injection moulded foam such as Polyurethane (PU). These materials offer an optimum balance between low density and high strength to enable a low mass but rugged device. The mouth of the horn 1101 would have a clear aperture diameter of between 100 and 1000 mm, or more preferably 311 mm. The throat of the horn 1102 would have a clear aperture diameter of between 10 and 100 mm, or more preferably 37 mm. The length of the horn 1103 would be between 200 mm and 1500 m, or more preferably 676 mm.

A further common addition to any horn-loaded compression driver is a phase plug. This is a component which sits within the confines of the horn itself. It acts as a waveguide to better control the propagating sound-wave from the transducer as it passes through the impedance matching horn. This waveguide has two primary functions: the first is to prevent localised destructive interference near the device from spatially offset acoustic wave components that may recombine out of phase. The second is to better control the directivity of the acoustic output. This technique is widely known for audio systems designed for broadband output in the reproduction of music and speech, however the dimensionality of a phase plug to maximise the directionality for a device emitting the specified narrow-band waveform is novel.

Figure 12:
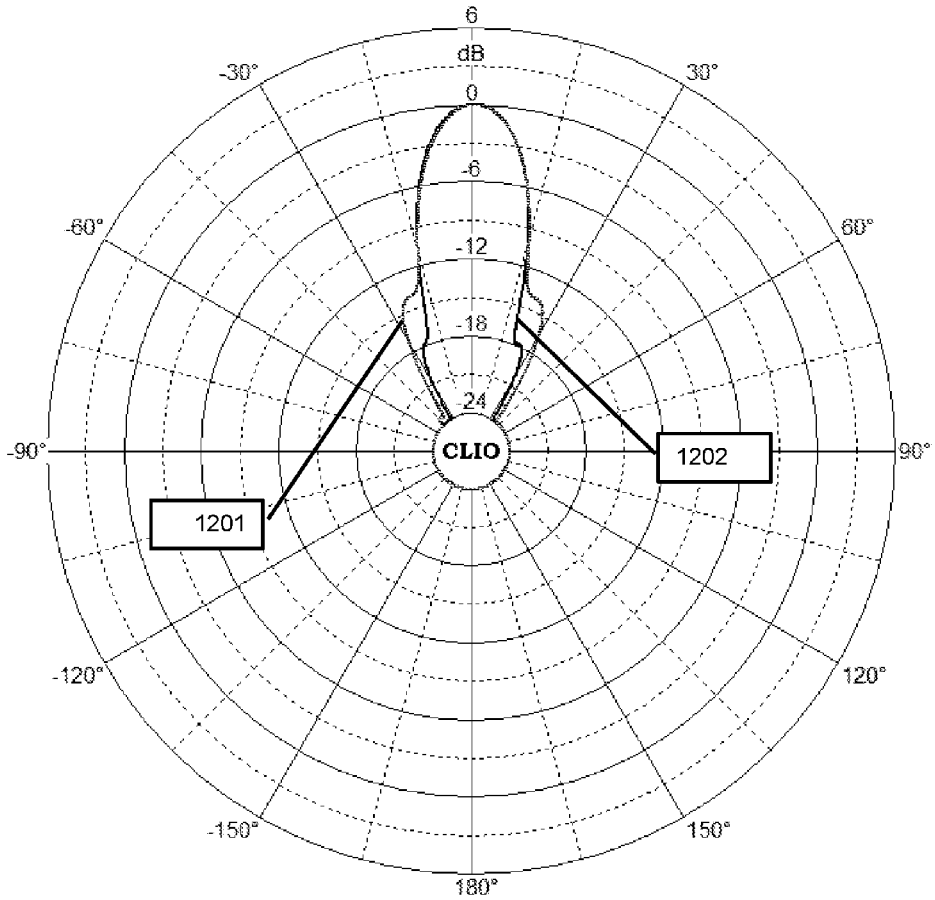
FIG. 12 shows a 360 degree polar profile from 0 to −24 dB comparing the directivity of the device without and with a suitable phase plug

FIG. 12 shows a 360 degree polar profile of the output of the device with and without an optimised phase plug, all at an output frequency of 4 kHz, and normalised to 0 dB over a range of 0 to −24 dB to allow direct comparison. The textured grey line 1201 shows the output of the optimised horn without a phase plug. The black line 1202 shows the output with the addition of an optimised phase plug. It can be seen that the addition of the phase plug significantly enhances the directivity of the device by virtually eliminating the symmetric "shoulders" that are otherwise present from −15 dB or so and which effectively broaden the primary output by many degrees.

Figure 13:
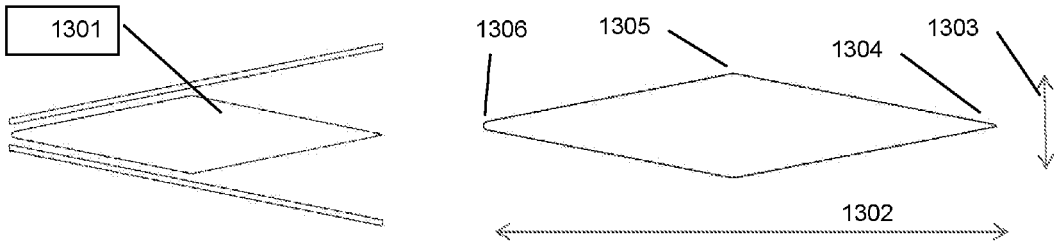
FIG. 13 shows a dimensioned cross section of the optimised phase plug and its position relative to the main horn

FIG. 13 shows a cross-sectional profile of the phase plug found to be optimal for the proposed device both within in the conical horn for context and separately to illustrate its key dimensions. It could be manufactured from any suitable material; metal, ceramic, stone plastic, carbon fibre or hardened foam; however the preferred embodiment is found to be either an injection moulded plastic such as Acrylonitrile Butadiene Styrene (ABS) or Polypropylene (PP) or a reaction injection moulded foam such as Polyurethane (PU). These materials offer an optimum balance between low density and high strength to enable a low mass but rugged device. The phase plug 1301 is shown in its optimal placement coaxial to the horn. It is has a biconic profile. The left hand radius 1306 is offset from the throat of the horn by a distance of between 0 to 500 mm, or more preferably by 4.5 mm. The length of the phase plug 1302 would be between 100 and 1000 m, or more preferably 670 mm. The maximum central diameter of the phase plug 1303 would be between 50 and 500 mm, or more preferably 141 mm. The profile at the mouth end 1304 would have a radius between 1 and 100 mm, or more preferably 1.5 mm. The profile at the apex 1305 would have a radius of between 1 and 200 mm, or more preferably 8.5 mm. The profile at the throat end 1306 would have a radius between 1 and 100 mm, or more preferably 6 mm.

Controlling off-axis emissions of the device is as important as narrowing the core-beam output for its functionality. This is essential to ensure that the user, who will be wearing the device on a shoulder strap, as well as nearby colleagues and bystanders will experience minimal sound levels compared to the target. This is as much a part of optimising the directivity as narrowing the primary output beam.

Figure 14:
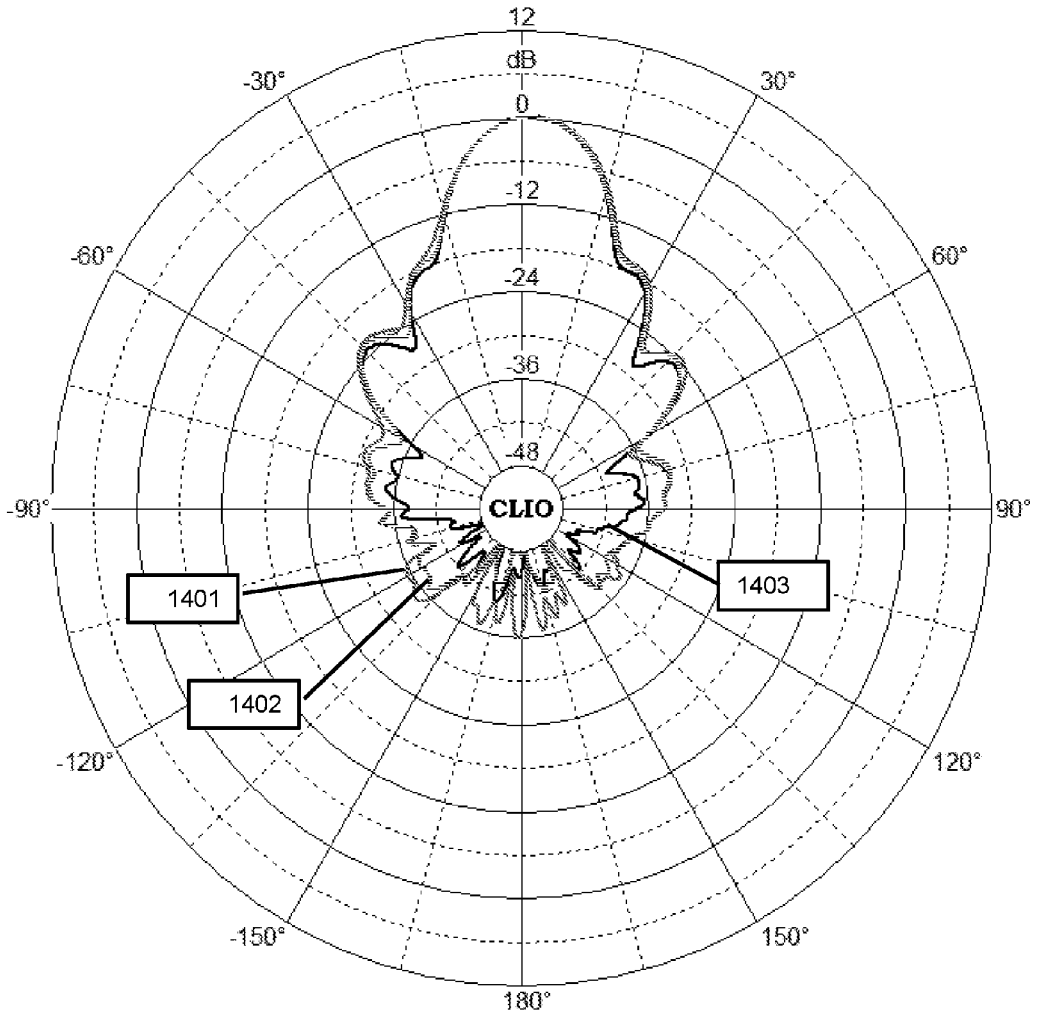
FIG. 14 shows a 360 degree polar profile from 0 to −48 dB comparing the directivity and off-axis emissions from the device with and without different acoustic foam rings around the horn exit aperture

It is found that adding a layer of acoustically absorbing foam around the aperture of the device can significantly attenuate the off-axis emissions. This could apply effectively to any shape of exit aperture. In this instance the horn is conic and therefore the optimum approach is to have a ring of foam around the aperture or mouth of the horn. Any acoustically absorbent foam with a range of densities between 5 kg/m$^3$ and 500 kg/m$^3$ may be applicable, but more preferably Basotec UF open-pore melamine foam which has a density of 11 kg/m$^3$. FIG. 14 shows a 360 degree polar profile of the output of the device without a foam ring around the aperture, with a non-optimised ring and with an optimised ring, all at an output frequency of 4 kHz, and normalised to 0 dB over a range of 0 to −48 dB to allow direct comparison. The 48 dB scale shows off-axis emissions from the device, off-axis, perpendicular to, and behind the core beam. The grey line 1401 shows the output of the device without a foam ring. The dashed line 1402 shows the output of the device with a foam ring that is not optimised. The black line 1403 shows the output of the device with the optimised foam ring. It can be seen that foam ring has minimal effect on the forward output over a range of +/−15 degrees. However from that point on it can significantly reduce emissions. The non-optimised foam ring 1202 is flush with the horn aperture and whilst there is minor improvement particularly at the rear of the device the effect is not marked. By comparison the optimised foam ring 1203 is proud of the horn aperture and the reduction in off-axis emissions is very significant. Several dB in the region of 15 to 60 degrees off-axis on either side of the main beam; but principally to the sides and rear of the device from 60 to minus 60 degrees where up to 6 dB or more reductions are achieved relative to the sound levels without the foam. This is particularly important for reducing the sound level experienced by the user who will carry the device on a shoulder strap and colleagues and bystanders to the rear or parallel to it. A 6 dB reduction is a halving of sound level in terms of pressure.

Figure 15:
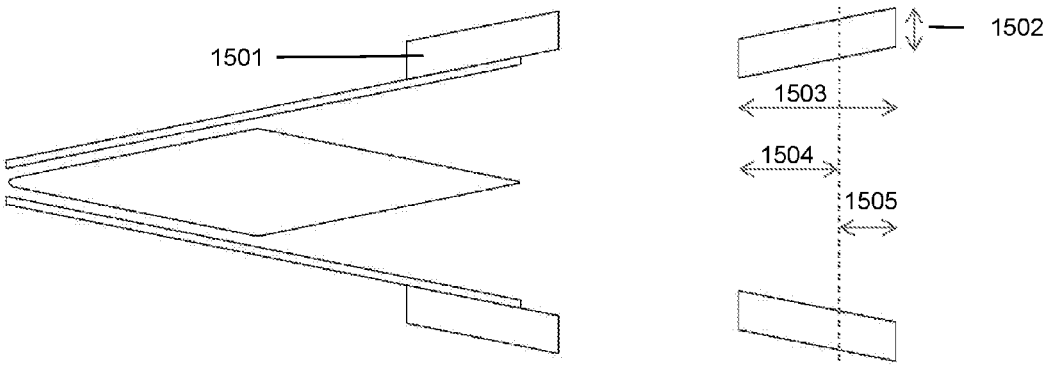
FIG. 15 shows a dimensioned cross section of the optimised foam ring and its position relative to the main horn

FIG. 15 shows a cross-sectional profile of the foam ring found to be optimal for the proposed device both mounted on the conical horn with phase plug for context and separately on the right to illustrate its key dimensions. The profile and position of the foam ring 1501 is shown around the aperture of the horn. Any shape of foam ring might be applicable, however it is found to be optimal for the foam ring to be in the form of a truncated cone which follows the outer contours of the horn. This offers the best compromise between minimising the volume of the device, to allow it to be worn comfortably by the user, and achieving the desired reductions in off-axis acoustic emissions. The dashed line indicates the relative position of the horn aperture. The thickness of the foam ring 1502 would be between 5 and 250 mm, or more preferably 50 mm. The length of the foam ring 1503 would be between 10 and 500 mm, or more preferably 200 mm. The proportion of the foam ring behind the horn aperture 1504 would be between 0 mm and 500 mm, or more preferably 150 mm. The proportion of the foam ring proud of the horn aperture 1505 would be between 0 mm and 500 mm, or more preferably 50 mm.

In an embodiment an acoustic foam ring or wrapping around the aperture of an acoustic source could be used in applications beyond that of the A-WaSP™. For example if applied to elements in a public address (PA) system it may be possible to reduce off-axis emissions to the rear, thus reducing sound levels behind or near the PA system. This could be of benefit in setting up stages at musical concerts, rallies or other gatherings where reducing the SPL on the stage would aid clarity for the performers, reduce the need for monitoring and reduce the propensity for feedback. This approach could be applied to any elements using in conventional PA systems; for example all loudspeakers, horn loaded compression drivers and tweeters. It could also be used in targeted audio advertising where it is desirable to make the audio information as localised as possible.

Figure 16:
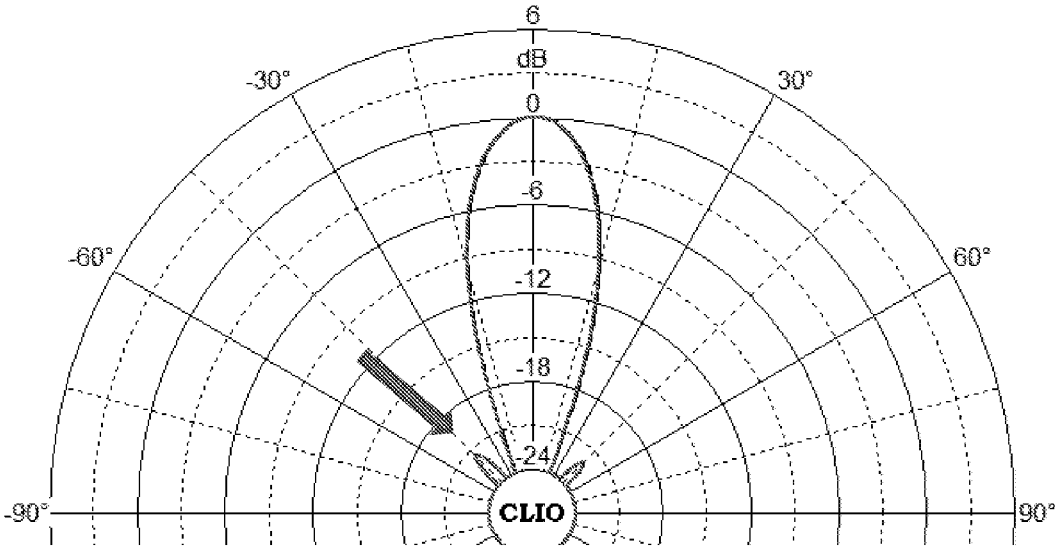
FIG. 16 shows a 180 degree polar profile from 0 to −24 dB highlighting the presence of off-axis lobes at 45 degrees from the core sound cone in a non-optimised condition

A key issue in achieving good directionality is found to be suppressing off-axis lobes. FIG. 16 shows a 180 degree polar profile from 0 to −24 dB at 4 kHz for a non-optimised output. The arrow indicates the presence of two symmetric off-axis lobes with an SPL around −21 dB from the main beam maximum at 45 degrees from the main beam. A −21 dB reduction means that these lobes are at less than 10% of the pressure level in the main beam. However, the human auditory response is non-linear and it is found in empirical testing that off-axis lobes such as these can be perceived—although not usually as discrete regions of higher intensity to the background—but as a broadening of the core beam. Thus the presence of lobing can profoundly reduce the impression of directivity of the device in practice. In the above example the impression of beam width is increased by more than 45 degrees.

The threshold at which such lobing becomes imperceptible is around −24 dB (or 6% of the max pressure level). At this point test subjects could not perceive the lobes, and so did not perceive a broadening of the device output. Therefore to maximise directivity it is as important to reduce lobing below this threshold as it is to achieve a narrow core beam.

A very counter-intuitive approach to suppress lobing as well as reducing off-axis emissions is discovered empirically to be mounting a foam ring inside the horn around the horn-mouth end of the phase plug. This is not obvious because putting an absorbing foam ring within a horn array might reasonably be presumed to drastically reduce output and degrade the directivity not enhance it. However if the position of the foam, its character and dimensions are carefully chosen the effect is found to be very beneficial to the overall directivity with minimal loss in output.

Figure 17:
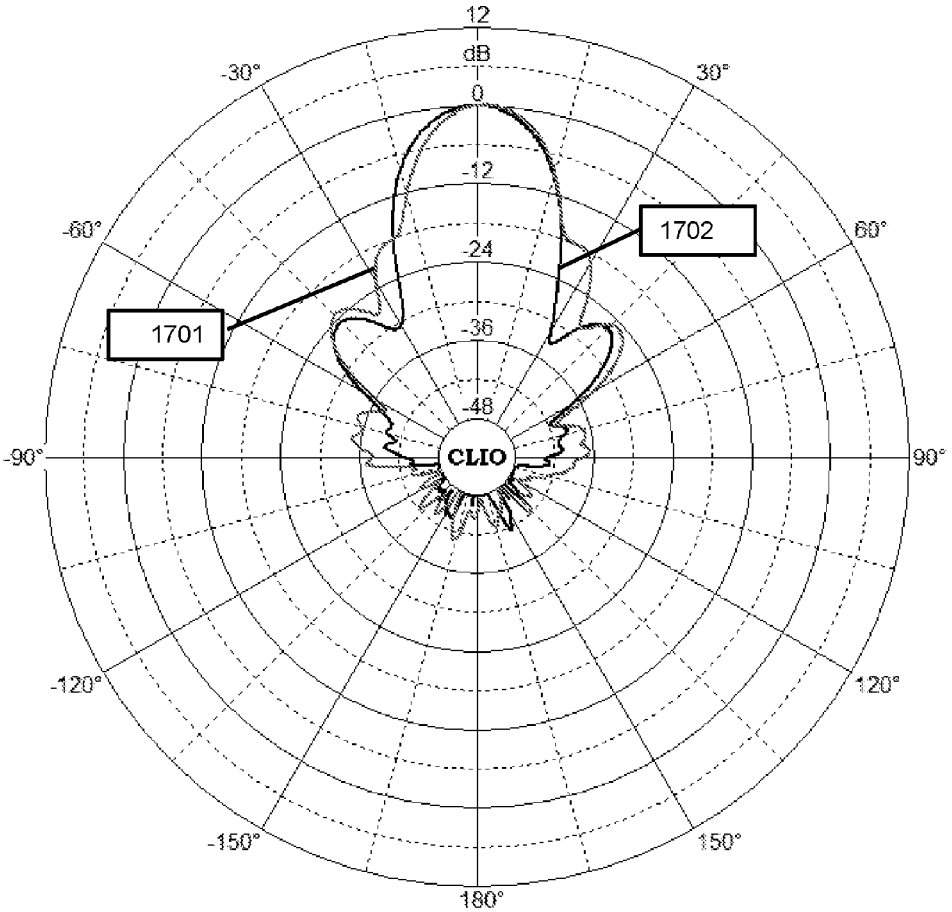
FIG. 17 shows the a 360 degree polar profile from 0 to −48 dB comparing the directivity and off-axis emissions from the device with and without an acoustic foam ring placed around the phase plug

FIG. 17 shows a 360 degree polar profile of the output of the device with and without an internal foam ring at an output frequency of 4 kHz, and normalised to 0 dB over a range of 0 to −48 dB to allow direct comparison. The grey line 1701 shows the optimised output of the device without an internal foam ring and the black line 1702 shows the output with an optimised internal foam ring positioned on the far side of the phase plug. As can be seen the benefit of this internal foam ring is very pronounced. The "shoulders" at around −18 dB are eliminated—significantly reducing the effective main beam width. The side lobes are reduced to levels several decibels below −24 dB rendering them imperceptible. From 60 to 90 degrees (on both sides) the emissions are reduced by as much as 6 dB to levels around minus 40 dB or below (1% of the pressure levels on-axis). To the sides and behind the device (+90 to −90 degrees) the sound levels are reduced to well under −42 dB (less than 0.8% of the pressure levels on-axis). The core beam at −6 dB to −18 dB has broadened by a few degrees but this is more than offset by the elimination of the shoulders which makes the perceived beam much narrower.

It is thought that the mechanism by which this internal foam ring enhances directivity is by absorbing some of the portion of the propagating acoustic wave-front that is diffracted by the apex of the phase plug. This diffracted wave-front would impinge in part upon the aperture end of phase plug at an acute angle and be reflected as off-axis shoulders/lobing. Furthermore this reflected off-axis emission would then be further partially diffracted by the clear aperture of the horn increasing the level of emissions to the sides and rear of the device. The addition of the internal foam ring reduces this effect significantly by absorbing some of the incident diffracted wave-front impinging on the phase plug. However it is critical to ensure that the dimensions and positioning of the internal foam ring are accurate. Too large a volume and output losses become unacceptable. Too little and the directivity enhancement is negligible.

Figure 18:
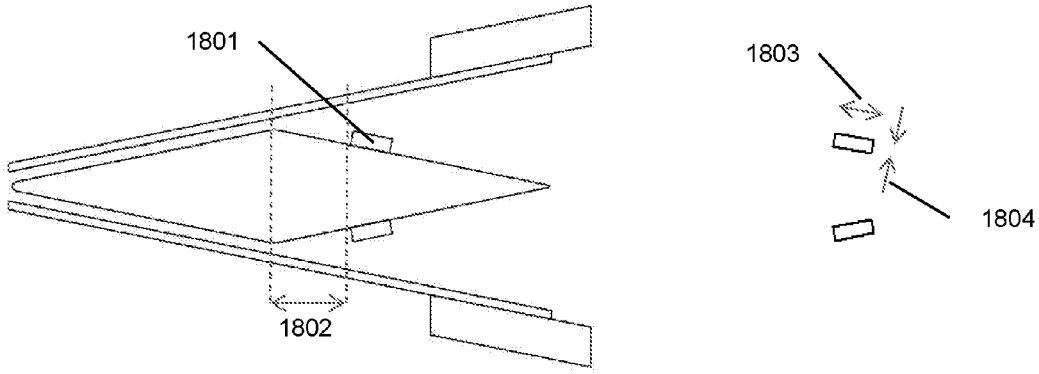
FIG. 18 shows a dimensioned cross section of the optimised phase plug foam ring and its position relative to the phase plug

FIG. 18 shows a cross-sectional profile of the internal foam ring found to be optimal for the proposed device both mounted on the phase plug, with the horn and external foam ring shown for context, and separately on the right to illustrate its key dimensions. The profile and position of the foam ring 1801 is shown around the mouth end of the phase plug. Any profile shape might be relevant depending on the structure of a phase plug (particularly a truncated cone) but in this case a rectangular cross-sectional strip wrapped around the phase plug is found to work best. The distance 1802 is the distance from the apex of the biconic phase plug to the optimal position of the internal foam ring. The distance 1802 would be between 0 and 500 mm, or more preferably 95 mm. The length of the foam ring 1803 would be between 10 and 500 mm, or more preferably 50 mm. The thickness of the internal foam ring 1804 would be between 10 and 200 mm, or more preferably 18 mm. Any acoustically absorbent foam with a range of densities between 5 kg/m$^3$ and 500 kg/m$^3$ would be applicable, but more preferably Basotec UF open-pore melamine foam which has a density of 11 kg/m$^3$.

In an embodiment an acoustic foam ring positioned around a phase plug could be used in applications beyond that of the A-WaSP™. For example if applied to elements in a public address (PA) system it may be possible to reduce off-axis emissions to the rear, thus reducing sound levels behind or near the PA system in certain frequency ranges. This could be of benefit in setting up stages at musical concerts, rallies or other gatherings where reducing the SPL on the stage would aid clarity for the performers, reduce the need for monitoring and reduce the propensity for feedback. It could also be used in targeted audio advertising or information points where it is desirable to make the audio information as localised as possible and so high directivity is desirable.

A further reduction in emissions to the sides and rear of the device can be achieved by wrapping the outer foam ring in fabric. This fabric can be any flexible material but more preferably a hard wearing nylon. Critically the fabric must be loose upon the foam. If it is tight then side emissions can increase due to reflections from the fabric surface. If it is loose the effect is neutral or absorbent. In addition the edge of the fabric must not extend beyond the aperture of the horn—see dashed line in FIG. 15. If it does then it creates a secondary aperture and the directivity is reduced by diffraction. Therefore the foam ring must remain uncovered by the wrapping from the point where it protrudes beyond the aperture, dimension 1505 on FIG. 15.

Figure 19:
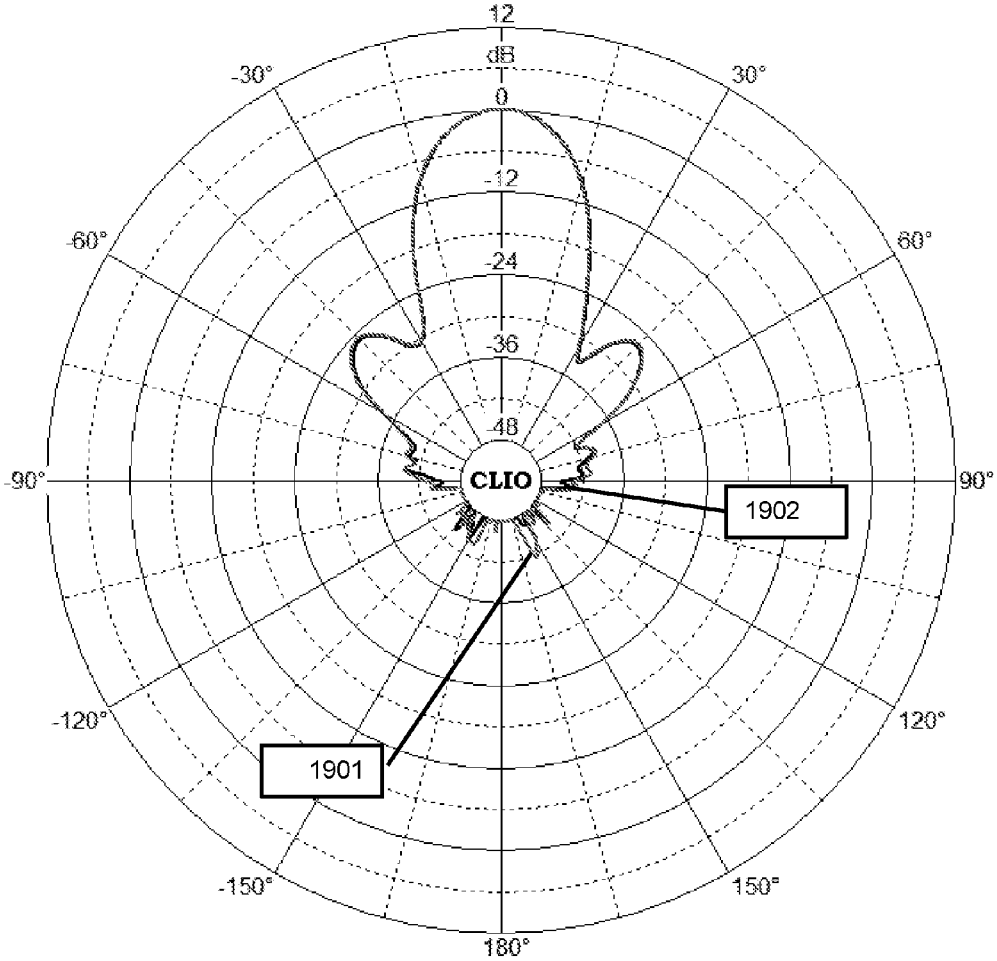
FIG. 19 shows the a 360 degree polar profile from 0 to −48 dB comparing the directivity and off-axis emissions from the device with and without an optimised fabric wrapping for the foam ring around the aperture

FIG. 19 shows a 360 degree polar profile of the output of the device with and without a wrapping of the external foam ring at an output frequency of 4 kHz, and normalised to 0 dB over a range of 0 to −48 dB to allow direct comparison. The grey line 1901 shows the optimised output of the device without wrapping and the black line 1902 shows the output with optimised wrapping of the external foam ring. The effect in the forward hemisphere of emission is negligible. The effect in the rear hemisphere reduces emissions in this area to around −45 dB or below of the on-axis SPL (less than 0.6% of the pressure levels on-axis). The wrapping has the added benefit of providing physical protection for the outer foam ring whilst in use.

Figure 20:
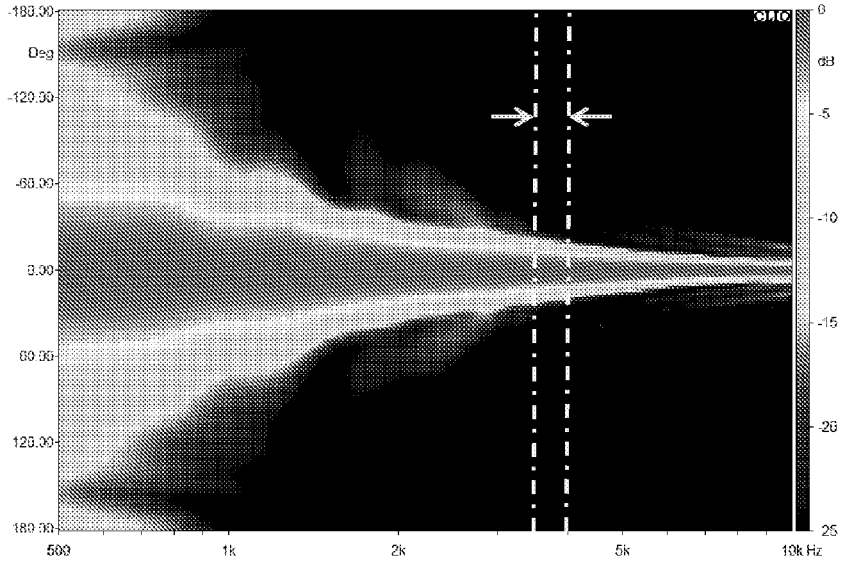
FIG. 20 shows a directivity plot for the optimised device over the frequency range 500-10,000 Hz on a 0 to −25 dB scale with a polar analysis from −180 to 180 degrees; the performance at the frequency range of interest 3500-4000 Hz is highlighted

FIG. 20 shows a plot of directivity of the optimised acoustic device over 360 degrees (+1-180 degrees centred at 0 degrees) but over a broad range of frequencies from 500 to 10,000 Hz. This is shown on a false colour scale from 0 to −25 dB. The frequency range of interest 3500 to 4000 Hz is indicated by the two dash-dotted lines and the arrows. As can be seen in this frequency range there is no perceptible side-lobing and the rate of SPL drop-off is very rapid once you move off-axis. It can be seen that the output beam narrows with increasing frequency. This can be attributed to diminished diffraction effects as the wavelength shortens. FIG. 20 serves to show that the output of the device is highly directional over the frequency range of interest and not just at 4 kHz as shown in the polar profiles.

It should be noted that the output from this configuration of horn, phase plug and inner and outer foam rings is extremely directional by the standards of any conventional PA system. Whilst unsuitable for the reproduction of music it may have application for the projection of directional verbal messages if these signals are digitally processed to complement the output characteristics of the device. This would be a distinct use from the criteria of the A-WaSP™ and could have application in targeted audio advertising, ranged verbal communication or information points where it is desirable to make the audio information as localised as possible and so high directivity is desirable.

Figure 21:
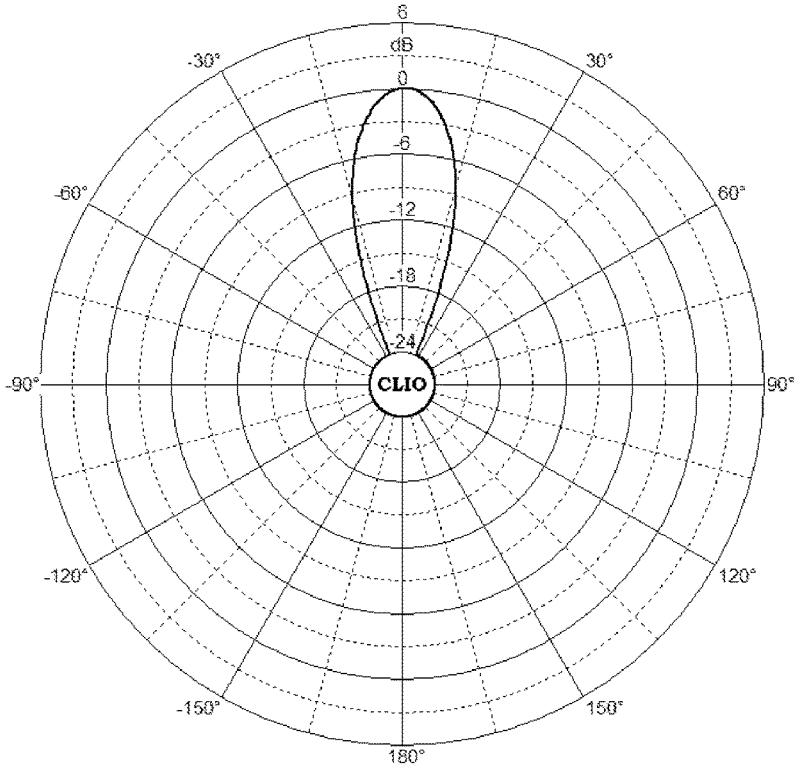
FIG. 21 shows a 360 degree polar profile from 0 to −24 dB showing the core beam directivity of the optimised device

FIG. 21 shows a 360 degree polar profile of the output of the fully optimised device at an output frequency of 4 kHz over a range of 0 to −24 dB which highlights the very high directivity of the primary output. It can be seen that there is no evidence of side lobing or shoulders above −24 dB. The core beam is very narrow with a divergence of only +1-7.5 degrees to −3 dB. This is primarily beneficial because those not being directly targeted will only experience a fraction of the SPL experienced by the target.

A further key element for the perception of directivity is found to be the rate of drop-off of the SPL by degree at the edges of the main sound beam. FIG. 21 shows that the average rate of drop-off is around −1.4 dB per degree from −3 dB to −24 dB; and approximately −1.8 dB per degree from −6 dB to −24 dB, which equates to a reduction in pressure of some 23% per degree.

This has the auditory effect of a very sudden and startling onset of acoustic intensity as a target moves into the beam and the reverse when a target moves out of it. This means that if a target instinctively moves away from the beam then they are instantly aware that they are moving out of it. The reverse mechanism will apply if someone moves into the beam, encouraging them to quickly move back out of it. Equally if the user sweeps the device across a group of people the sensation of being targeted by the core beam as it passes is unmistakable.

Figure 22:
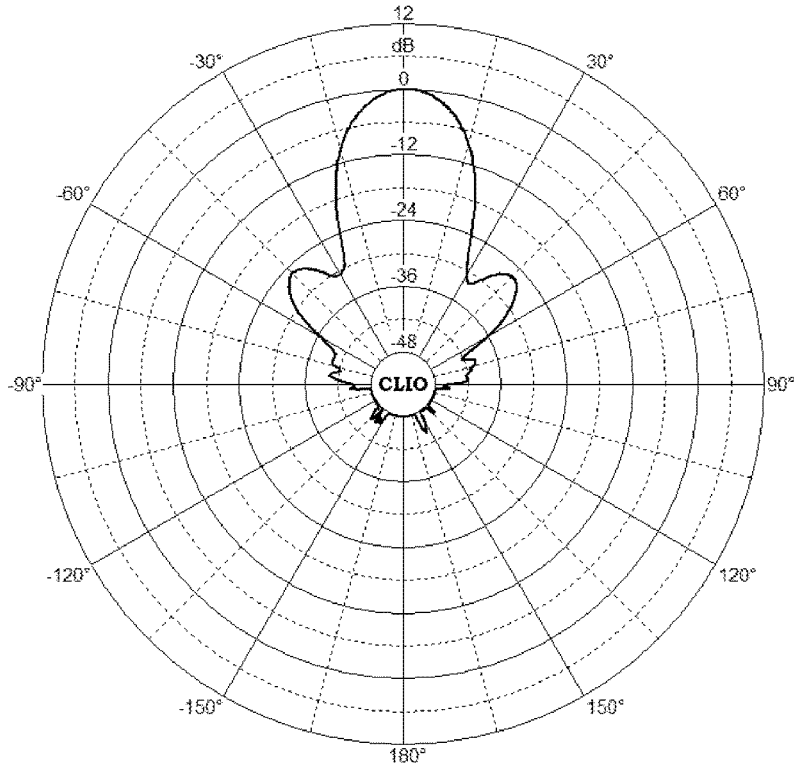
FIG. 22 shows a 360 degree polar profile from 0 to −48 dB showing the directivity of the optimised device including off-axis emissions

FIG. 22 shows a 360 degree polar profile of the output of the fully optimised device at an output frequency of 4 kHz over a range of 0 to −48 dB which highlights the very low levels of lobing and side emissions. The side lobes at +1-45 degrees have a maximum SPL of around −26 dB of the core beam, or 5% as a function of pressure—a low level which is not distinct and so does not diminish the perception of directionality. As you move further off-axis the relative sound level drops off even further, below −36 dB from +1-50 degrees and down to approximately −40 dB from 60 degrees to 90 degrees off-axis, or 1% of the pressure level in the core beam. This shows that any bystanders outside the core beam experience a very much lower SPL than the target and this level continues to diminish rapidly as you move further off-axis. To the sides and rear of the device the relative SPL reduces further still, reaching levels around −44 dB, or 0.6% of the pressure level in the core beam. This is particularly beneficial to the user of the device who will experience a pressure level 150 times less than the target would at 1 m range. The same low level applies to colleagues or bystanders who are adjacent to the device. Such low SPL off-axis means that hearing protection is unnecessary for the user and their colleagues, even for extended use, and that normal conversation is possible even when the device is operating at maximum output.

Figure 23:
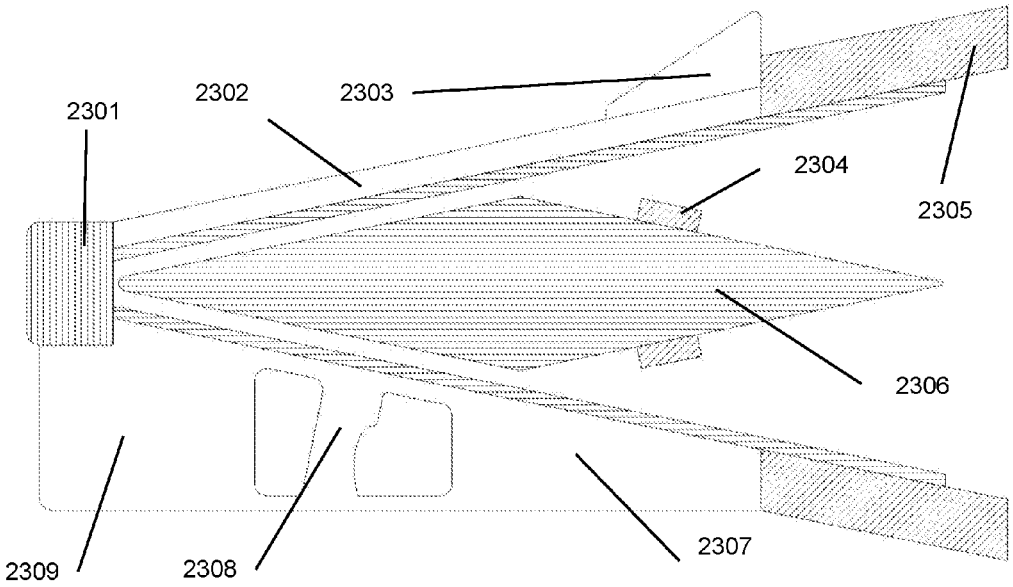
FIG. 23 shows a schematic of the cross-section of the optimised device showing the relative position of key components

FIG. 23 shows a cross section of the device by component and location. The transducer 2301 a compression driver of type Radian 745 NEO PB is attached to the throat of the horn. The main horn of the acoustic device and the phase plug mounted coaxial to it 2306 both have horizontal shading. The outer foam ring 2305 and inner foam ring around the phase plug 2304 both have diagonal shading. The body of the device 2302 is shown in white outline. It could be manufactured from any suitable material; metal, ceramic, stone plastic, carbon fibre or hardened foam; however the preferred embodiment is found to be either an injection moulded plastic such as Acrylonitrile Butadiene Styrene (ABS) or Polypropylene (PP) or a reaction injection moulded foam such as Polyurethane (PU). The flat panel display which shows the camera feed is housed in 2303 and a suitable unit would be a 5.7" high-brightness display such as the DET057VGHLNTO-1A from Densitron PLC. The battery would be positioned at location 2309 and a suitable model unit would be an L96e Lithium Ion rechargeable battery from PAG Ltd. The handle and trigger to control the device is located at position 2308. The control electronics are located within a cavity in the device located at position 2307. This would incorporate a control PCB which would include the sound reproduction electronics and amplifier which drive the transducer. The waveform is recorded as a WAV file at 96 kHz sample rate and 16-bit resolution. It is stored upon the CPU chip in integral flash memory. A suitable audio codec would be a WM8523GEDT made by Wolfson Microelectronics. A suitable preamp would be an OPA1632DG4 made by Texas Instruments. A suitable power amplifier would be a TAS5630B made by Texas Instruments. The camera and laser range finder are not shown as they recessed within the outer foam ring 2305; suitable models would be a VB21EH-W bullet camera from RF Concepts Ltd and an ILM150 Class 1 laser range finder from MDL Ltd.

Figure 24:
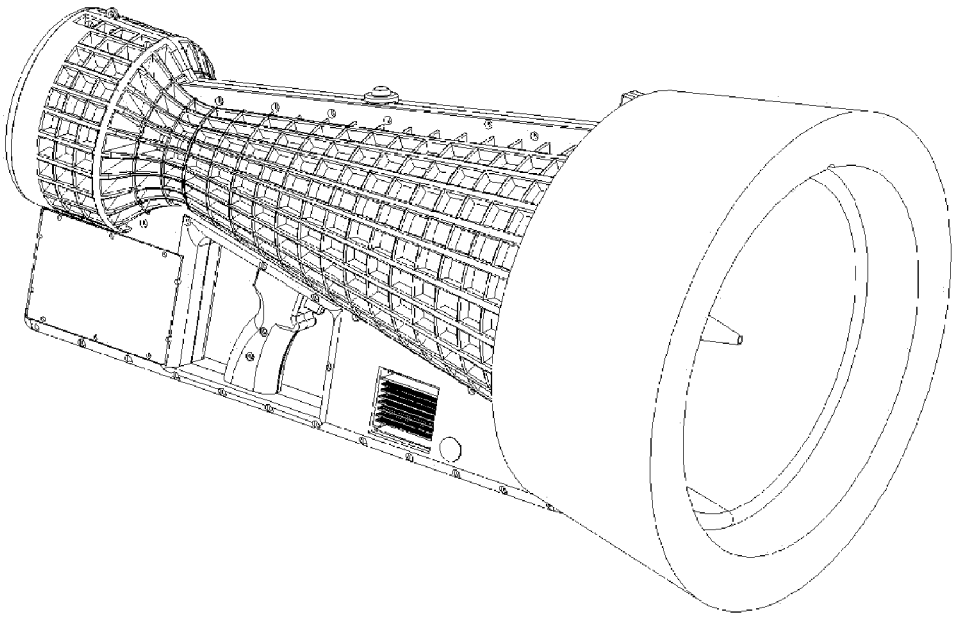
FIG. 24 shows a CAD drawing of a real prototype device

The preferred design is for a multiple piece moulded part which bolts together to create a self-contained unit. Channels are created within this unit for the wiring loom to connect the electrical components together. FIG. 24 shows the CAD rendering of a real prototype device which has been tested and demonstrated successfully to third parties. It is either worn across the chest of the user, or positioned at waist height. It is held upon a shoulder strap (not shown) and can be worn comfortably for more than half an hour at a time.

A key feature of this device is the ability for it to operate within the framework of existing health and safety legislation. The acoustic output waveform is designed to maximise the impression of intensity of sound at the target. This means that the actual SPL can be minimised as far as possible; to ensure that the dosage experienced by the target falls within legal limits; but still be perceived as a forceful warning that cuts through any ambient noise. The very high directionality of the device when projecting this sonic waveform means that the dosage is selectively applied to the target and can be carefully controlled. Equally important is that bystanders and the user experience a very low sound level by comparison and so even with protracted use will not experience a dosage that exceeds legal limits. Compliance with pre-existing health and safety legislation is thought to be unique for any technology current used on the Force Escalation Spectrum to manage conflict.

The relevant legislation is for the control of noise at work. The European legislation in this area is DIRECTIVE 2003/10/EC OF THE EUROPEAN PARLIAMENT AND OF THE COUNCIL of 6 Feb. 2003 on the minimum health and safety requirements regarding the exposure of workers to the risks arising from physical agents (noise) (Seventeenth individual Directive within the meaning of Article 16(1) of Directive 89/391/EEC). This is guided by the ISO standard; Acoustics—Determination of occupational noise exposure and estimation of noise-induced hearing impairment, ISO 1999:1990. US legislation is also derived from this ISO standard and there are two national bodies; the Occupational Safety and Health Administration (OSHA) and the National Institute of Occupational Safety & Health (NIOSH) which put forward slightly different standards for Occupational Noise Exposure for the USA.

The acoustic device has maximum output limited to 137 dB(A) at 1 m, which is half the power level of the instantaneous limit of 140 dB(C) specified in all the above standards. This ensures that even an accidental exposure at full power at point blank range would not breach the above standards assuming that it is immediately discontinued.

Figure 25:
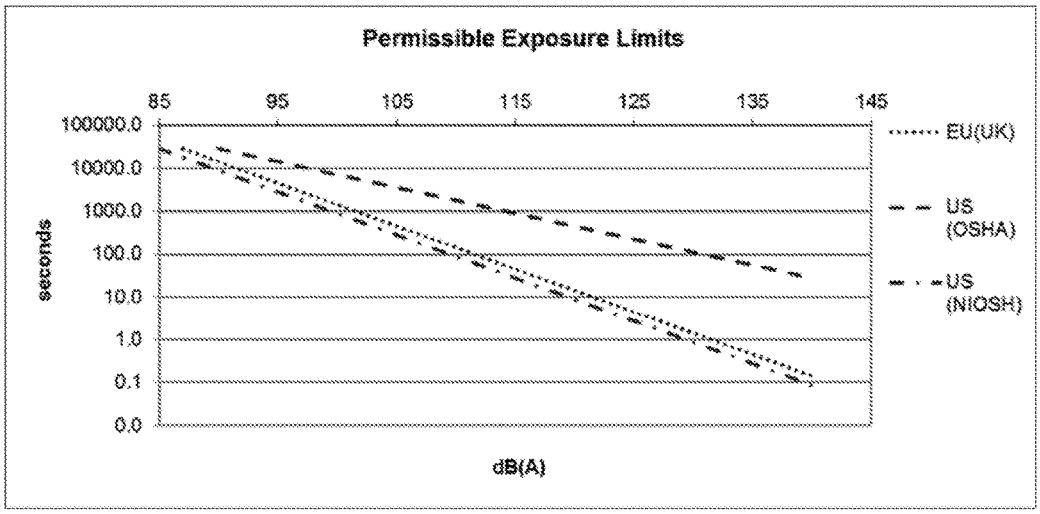
FIG. 25 shows a logarithmic graph showing permissible daily exposure time in seconds by sound pressure level for European Union law and the two United States agencies responsible for health and safety at work

Permissible noise exposure is based on an 8 hour working day and is cumulative. Thus under EU law a person may be exposed to a maximum average sound level over an 8 hour period of 87 dB $L_{Aeq}$; but that may come in shorter bursts at higher sound levels as long as the average is not exceeded. FIG. 25 shows the permissible daily maximum exposure limits in seconds on a logarithmic scale as a function of SPL in dB(A). The dotted line shows the threshold for EU (UK) legislation, whilst the dashed line corresponds to US (OSHA) and the dot-dash line to US (NIOSH). All follow the same principal but the maximum limits vary. If the target, user and bystanders do not exceed the relevant cumulative dose in an 8 hour period then they cannot be said to have been put at any risk of injury; thus making the use of the device highly defensible.

Figure 26:
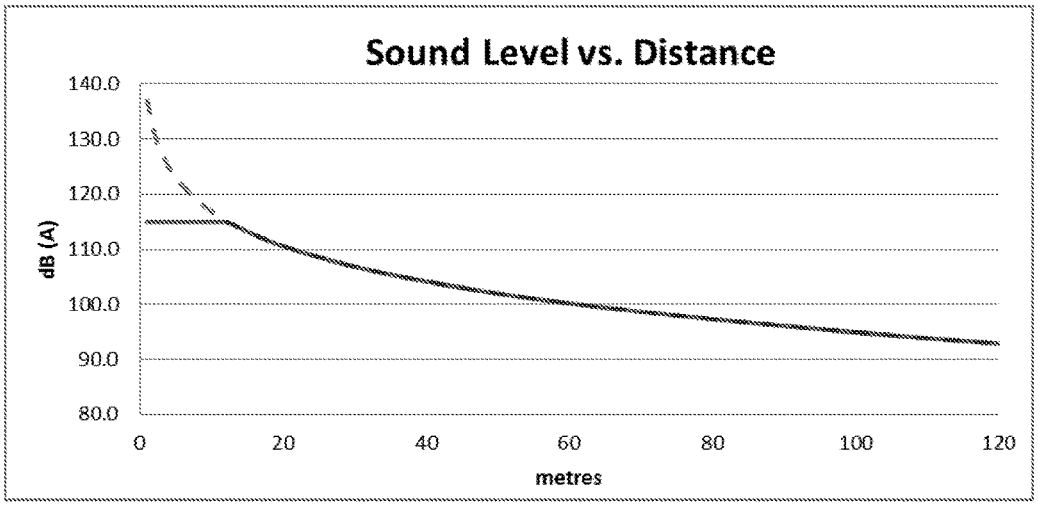
FIG. 26 shows the sound pressure level produced by the device at ranges from 1 to 120 m plus the effect of the safety limiter function in controlling the maximum sound pressure level at short range

A key element to compliance with health and safety legislation is the addition of a laser range finder. A suitable model would be an ILM150 Class 1 laser range finder from MDL Ltd. The user aims the device and presses the trigger button at which point a built in laser range finder instantly measures the distance to the target. A pre-determined maximum sound level is programmed into the device. The device output will be automatically adjusted by reference to a look-up table in the control software before acoustic emission begins so that the sound level will not exceed that maximum level at the measured range. This is very rapid and virtually imperceptible to the user. This limiting function shown in FIG. 26 which plots SPL in dB(A) over a distance range of 1 to 120 m. SPL naturally diminishes as the sound cone diverges with distance and also with atmospheric absorption. The grey dashed line shows the unlimited output with a peak SPL of 137 dB(A) at 1 m. The solid grey line shows it limited to a predetermined level (in this case 115 dB $L_{Aeq}$ as specified by the UK Police Service). This corresponds to a distance of 13 m from the device. Thus for any target below 13 m the SPL cannot exceed 115 dB $L_{Aeq}$. This maximum level can be adjusted to suit specific user requirements.

To further control exposure the device is limited to outputting 3 s bursts of acoustic emission before it automatically cuts-out for 1 s before the acoustic output can be triggered again. This forces the user to deploy the device in bursts and prevents them from "hosing down" a target—encouraging an approach of controlled progressive doses. Furthermore it is found that bursts are more effective at conveying a warning of Police attention than constant exposure; a burst of sound being more attention grabbing.

Under EU legislation a sound level of 115 dB $L_{Aeq}$ is permissible for 45 s per day. This equates to 15 bursts of 3 s—well in excess of that required to persuade a target to desist. If the target continues after even 5 bursts then the user should consider moving up the Force Escalation spectrum. Also in an open environment the user and adjacent bystanders would typically experience a maximum of 95 dB $L_{Aeq}$ at maximum output—equating to a daily dosage limit of 1 hour 16 minutes or more than 1500 bursts of 3 seconds—plenty of headroom.

A problem in using any acoustic device is aiming it accurately. To that end a video camera is mounted in the device aligned to the acoustic output. A preferred embodiment is for this camera to operate well in both bright-light and low-light conditions. A suitable model would be a VB21EH-W bullet camera from RF Concepts Ltd. The video feed is then sent to a high brightness flat panel display which is mounted in the device such that the user can easily see it. High brightness is desirable so that it can be seen even in direct sunlight. A suitable model would be a 5.7" high-brightness display such as the DET057VGHLNTO-1A from Densitron PLC.

Figure 27:
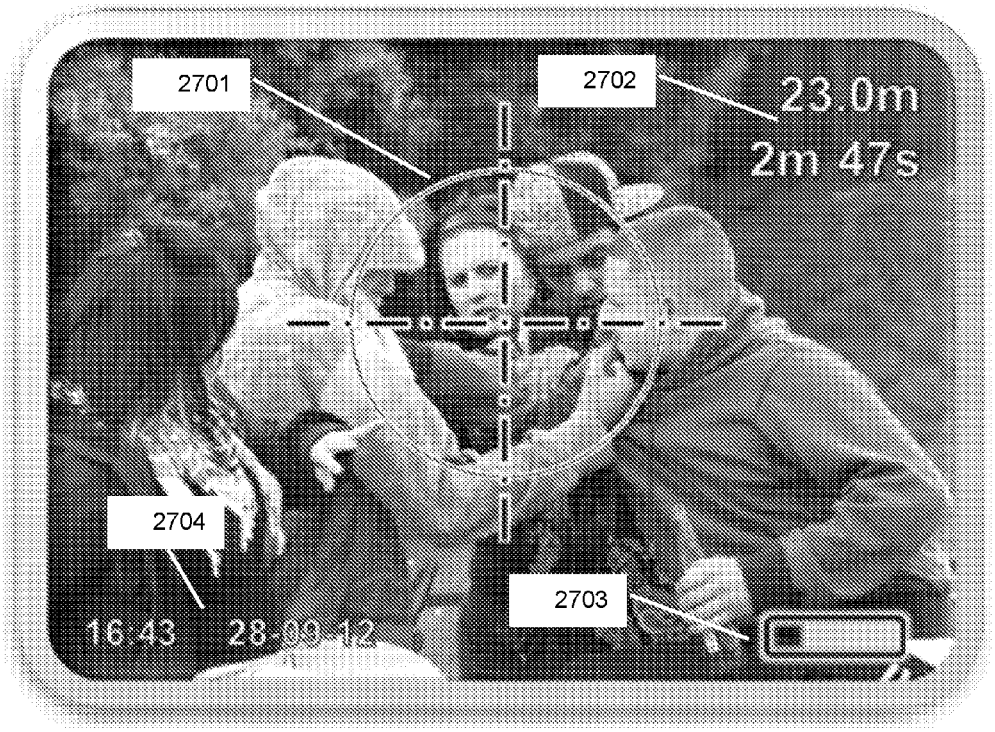
FIG. 27 shows a graphic illustrating the video feed and overlay that the user of the device can see on the integral flat panel display to help them aim and use the device effectively

FIG. 27 shows a graphical representation of the image the user would see upon the flat panel display screen. Cross-hairs 2701 are overlaid on the live video feed to help the user aim the device accurately and easily. Further information is overlaid on the screen to help the user. The measured range to the target and maximum length of safe exposure at the corresponding sound pressure level is shown to help the user assess and control the dosage for any given target 2702. A battery charge indicator 2703 is also shown as well as time and date information 2704.

Recording how the device is used is critical in justifying its compliance to local health and safety law but also in demonstrating that it has been use proportionately in managing conflict. To that end a Global Positioning System (GPS) unit is incorporated within the device. A suitable model would be a W2SG0008i made by Wi2Wi. This GPS unit can provide real time location coordinates as well as accurate date and time. Which combined with the video feed from the camera and range, plus corresponding sound level and dosage, as determined from the laser range finder—creates a compelling body of information that is automatically recorded with every press of the device trigger.

Figure 28:
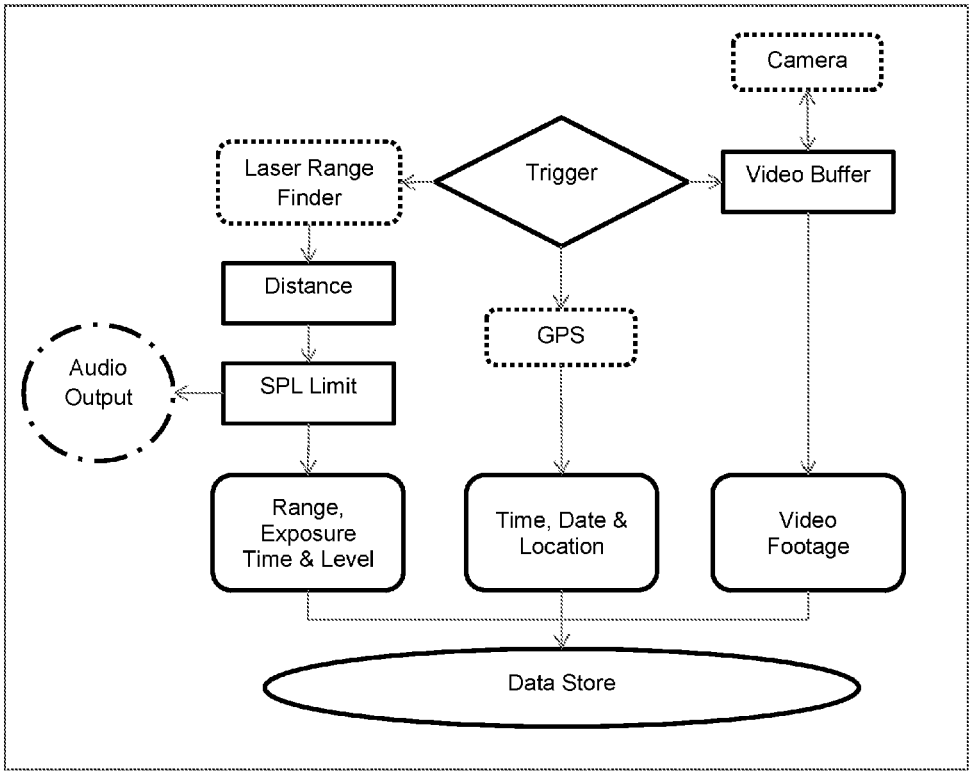
FIG. 28 is a diagrammatic representation of how the device creates and stores an evidential trail of its use

FIG. 28 shows a flow diagram of how this works. The range, sound exposure level at the target, exposure time, time, date and GPS coordinates (location) of the device are all recorded with each trigger press. This data is stored as a comma separated value file. In parallel video footage is recorded from the integral camera, furthermore a video buffer function is employed such that when the trigger is pressed the previous 20 s of camera footage is seamlessly included in the video file to provide context of use. Once the trigger is released the video continues to save for a further 60 s to give further context. This is stored as a single MPEG4 video file. Both files are stored on an internal removable flash memory drive.

These files provide a comprehensive record of use and provide the user with very strong evidence to refute any allegations of misuse of the device—discouraging expensive legal challenges from members of the public. Furthermore they also discourage misuse of the unit because the operator knows that all uses will be comprehensively recorded and that there will be suspicion should those records be found to be missing.

It is to be understood that various modifications to the preferred embodiment and the generic principles and features described herein will be readily apparent to those skilled in the art. Thus, the present system is not intended to be limited to the embodiment shown and such modifications and variations also fall within the spirit and scope of the appended claims.

The invention claimed is:

1. A directional acoustic warning device, suitable for creating a greater sound pressure at a selected target than around the target, wherein the device has a sound pressure generating source coupled to a sound guiding structure, wherein the sound pressure generating source comprises an electronic signal generating system connected to a transducer, the transducer being capable of converting electronic signals from the signal generating system to sound pressure waves, and wherein the signal generating system is arranged to produce a first signal having a waveform with a frequency which is varied around a first resonant frequency of the human ear canal, and wherein the sound guiding structure includes an open-ended cone-shaped horn having a narrow end and a wide end, wherein the narrow end of the horn is located toward the sound pressure generating source and, a horn ring of acoustically absorbent material provided at the wide end of the horn, and, a phase plug provided within the horn, and a phase plug ring of acoustically absorbent material provided around a part of the phase plug, and wherein the dimensions of the horn and the phase plug and the position and dimensions of the horn ring and phase plug ring are selected to maximise the directionality of the sound and minimise sound level exposure to a user of the device and bystanders at frequencies around the first resonant frequency of the human ear canal;

wherein the acoustically absorbent material is acoustically absorbent foam;

wherein a portion of the horn ring is covered in loose-fitting fabric.

2. A directional acoustic warning device in accordance with claim 1, wherein the signal generating system is arranged to produce a signal having a waveform with a frequency which is modulated between a lower limit and an upper limit.

3. A directional acoustic warning device in accordance with claim 1 wherein the signal generating system is arranged to produce a second signal contemporaneously with the first signal, and wherein the frequency of the second signal is related to the frequency to the first signal.

4. A directional acoustic warning device in accordance with claim 1, wherein the waveform is a sinusoidal waveform.

5. A directional acoustic warning device in accordance with claim 1, where the signal generating system is arranged to also produce a pink noise signal.

6. A directional acoustic warning device in accordance with claim 1, wherein the length of the phase plug is equal to the length of the straight-walled hollow cone.

7. A directional acoustic warning device in accordance with claim 1, wherein a sound limiter is provided in communication with the signal generating system, which is arranged to limit the sound pressure level at the target.

8. A directional acoustic warning device in accordance with claim 7, wherein a laser range finder is provided to determine the distance between the device and a target and the sound limiter is arranged to limit the sound level at the target based on the distance between the device and the target as determined by the laser range finder.

9. A directional acoustic warning device in accordance with claim 7, wherein the sound limiter is arranged to limit the duration of the signals produced by the signal generator and/or the period between use of the device.

10. A directional acoustic warning device in accordance with claim 1, wherein a video camera is provided for aiming the device.

11. A directional acoustic warning device, suitable for creating a greater sound pressure at a selected target than around the target, wherein the device has a sound pressure generating source coupled to a sound guiding structure, wherein the sound pressure generating source comprises an electronic signal generating system connected to a transducer, the transducer being capable of converting electronic signals from the signal generating system to sound pressure waves, and wherein the signal generating system is arranged to produce a first signal having a waveform with a frequency which is varied around a first resonant frequency of the human ear canal, and wherein the sound guiding structure includes an open-ended cone-shaped horn having a narrow end and a wide end, wherein the narrow end of the horn is located toward the sound pressure generating source and, a horn ring of acoustically absorbent material provided at the wide end of the horn, and, a phase plug provided within the horn, and a phase plug ring of acoustically absorbent material provided around a part of the phase plug, and wherein the dimensions of the horn and the phase plug and the position and dimensions of the horn ring and phase plug ring are selected to maximise the directionality of the sound and minimise sound level exposure to a user of the device and bystanders at frequencies around the first resonant frequency of the human ear canal;

wherein the phase plug is a bi-conic shape, formed from first and second straight-walled cones each cone having a tip end and a base end which is wider than the tip end, wherein the cones are joined at their base ends to form an apex of the bi-conic shape, and mounted within the horn such that a first cone of the phase plug has a tip end towards the throat of the horn cone.

12. A directional acoustic warning device in accordance with claim 11, wherein the second cone of the phase plug has a ring of acoustically absorbent foam coaxially mounted on its surface.

13. A directional acoustic warning device in accordance with claim 11, wherein the horn ring is positioned between 0 cm and 50 cm from the apex of the phase plug.

14. A sound guiding structure for an acoustic device, including a straight-walled cone-shaped horn having a throat end for connecting to a sound pressure source and an open mouth end, wherein the throat end is narrower than the mouth end, and wherein a phase plug is mounted within the horn and spaced from the inner wall of the horn, wherein the phase plug is a bi-conic solid shape, formed from first and second straight-walled cones joined at their bases, and mounted within the horn such that the first cone of the phase plug has a tip end towards the throat of the horn cone, and wherein the second cone of the phase plug has a ring of acoustically absorbent material coaxially mounted on its surface.

* * * * *